US009687904B2

(12) United States Patent
Dunwoody et al.

(10) Patent No.: US 9,687,904 B2
(45) Date of Patent: Jun. 27, 2017

(54) METHOD AND APPARATUS FOR MANUFACTURING A CAN END

(71) Applicant: CROWN PACKAGING TECHNOLOGY, INC., Alsip, IL (US)

(72) Inventors: Paul Robert Dunwoody, Oxfordshire (GB); Andrew Robert Lockley, Oxfordshire (GB); Philip Alan Marriot, Oxfordshire (GB); Stephen John Osborn, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/783,599

(22) PCT Filed: Apr. 10, 2014

(86) PCT No.: PCT/EP2014/057261
§ 371 (c)(1),
(2) Date: Oct. 9, 2015

(87) PCT Pub. No.: WO2014/167052
PCT Pub. Date: Oct. 16, 2014

(65) Prior Publication Data

US 2016/0059297 A1 Mar. 3, 2016

(30) Foreign Application Priority Data

Apr. 12, 2013 (GB) ..... 1306765.7

(51) Int. Cl.
*B21D 51/44* (2006.01)
*B65D 1/16* (2006.01)

(52) U.S. Cl.
CPC ..... *B21D 51/44* (2013.01); *B65D 1/16* (2013.01)

(58) Field of Classification Search
CPC B21D 51/44; B21D 51/2623; B21D 51/2615; B21D 51/26; B65D 1/16
(Continued)

(56) References Cited

U.S. PATENT DOCUMENTS 4,606,472 A 8/1986 Taube et al.
6,419,110 B1 * 7/2002 Stodd ..... B21D 51/32 220/615
(Continued)

FOREIGN PATENT DOCUMENTS

EP 0153115 A2 8/1985
WO WO 2006/015175 A2 2/2006
WO WO 2014/167052 A1 10/2014

*Primary Examiner* — Robert J Hicks
*Assistant Examiner* — Kareen Thomas
(74) *Attorney, Agent, or Firm* — Baker & Hostetler LLP

(57) ABSTRACT

There is disclosed herein a method of forming a can end comprising: holding a peripheral portion of a blank between inner (60, 70) and outer (80, 90, 100) peripheral tool sets; drawing a central portion of the blank against an outer center panel tool (80) having a central region and a sloping peripheral edge (84) extending to a peripheral wall (86) by moving the outer center panel tool (80) inwardly relative to the peripheral tool sets to form a drawn can end shell (10); and reforming the can end shell (10) against an inner center panel tool (60) having a central region and a peripheral region by moving the inner center panel tool (60) outwardly relative to the peripheral tool sets to reform the drawn central portion to have a center panel defined by the central region of the inner center panel tool (60) and a recessed reinforcing structure extending around the center panel, wherein the sloping peripheral edge (84) of the outer center panel tool (80) has a convex radius of curvature of 2 mm or more and 30 mm or less between the central region of the
(Continued)

outer center panel tool (80) and the peripheral wall (86) of the outer center panel tool (80). A related apparatus is also disclosed.

6 Claims, 14 Drawing Sheets

(58) Field of Classification Search
USPC ..... 220/608, 610–624, 906; 413/8, 6, 5, 4, 2
See application file for complete search history.

(56) References Cited

U.S. PATENT DOCUMENTS

| | | | | |
|---|---|---|---|---|
| 7,591,392 | B2 * | 9/2009 | Watson | B65D 17/08 220/619 |
| 7,938,290 | B2 * | 5/2011 | Bulso | B65D 7/04 220/258.2 |
| 8,313,004 | B2 * | 11/2012 | Stodd | 220/619 |
| 2005/0252922 | A1 * | 11/2005 | Reed | B65D 17/08 220/619 |
| 2012/0067102 | A1 | 3/2012 | Stodd | |

* cited by examiner

METHOD AND APPARATUS FOR MANUFACTURING A CAN END

CROSS-REFERENCE TO RELATED APPLICATIONS

This application is the National Stage of International Application No. PCT/EP2014/057261, filed Apr. 10, 2014, which claims the benefit of GB application number 1306765.7, filed Apr. 12, 2013, the disclosures of which are incorporated herein by reference in their entirety.

FIELD

This invention relates to metal packaging and more particularly to a method and apparatus for manufacturing a can end, as well as to related can ends and to can end shells which can be re-formed into such can ends. The invention is particularly concerned with the manufacture of can ends for carbonated drinks cans.

BACKGROUND

In a typical conventional method of manufacturing can ends, a sheet metal blank is positioned between a pair of dies which are moved to shear an edge of the blank, after which a punch descends to draw the now circular blank about an annular ring into a can end shell having a peripheral flange, a frustoconical wall, and an end panel connected to the frustoconical wall by an annular curved or radiused wall portion defining a radius of curvature between the frustoconical wall and the end panel. The can end shell is then removed from the first set of dies and inserted into a second set of dies, in which the peripheral flange is curled into a downward peripheral flange suitable for double seaming operations. Subsequently, the end shell is then placed between another pair of dies, which, when moved towards each other, form the curved or radiused connecting wall and the end panel of the shell into a domed central panel with a surrounding annular reinforcing channel or groove connecting the central panel to the frustoconical wall.

More recently, the conventional pairs of dies have been replaced by sets of concentric tools, allowing the sequential operations of drawing the can end shell from a flat circular blank, and then re-forming it to provide the domed central panel and annular reinforcing channel or groove, to be carried out at a single forming station, in a single manufacturing operation.

In conjunction with the advanced tooling and manufacturing techniques available for manufacturing such can ends, the design of the can ends has also developed. In general, there has been a drive to improve the strength of the shape of the can end, so that the thickness of the material from which the can end is made can be reduced whilst maintaining an equivalent pressure performance. As well as improving the absolute strength of the can ends, it is also necessary to ensure that the can ends exhibit an appropriate failure mode in the event that the internal pressure within the can should exceed that for which the can end is rated, for example due to handling and processing conditions to which the can is subjected, or as a result of the can being dropped, etc.

Some of the changes to can end geometry, in order to try to obtain an approved can end performance, include varying the configuration of the chuckwall, varying the configuration of the annular reinforcing groove or channel, and varying the configuration of the centre panel and the panel wall connecting the centre panel to the annular groove or channel.

Features introduced into the can end structure to improve the can end pressure performance can include bends, kinks and double angles in the chuckwall, changes in the radius of curvature at the base of the countersink, and the provision of stepped or otherwise complex panel wall structures. In certain arrangements, the chuckwall may even extend radially inwardly over the base of the countersink or annular reinforcing channel or groove, so as to create a concavo-convex wall structure. In such cases, the concavo-convex structure may be formed as a series of folds or otherwise as adjacent and oppositely curved reinforcing beads.

However, the more complicated the can end structure, the greater the amount of processing which the material of the original blank has to undergo in order to be formed into the desired end shape. The more the material is processed, the greater the amount of thinning that the material is likely to suffer due to the processing, in particular in the step of drawing the circular blank so as to form a can end shell. Thinning of the material during drawing reduces the strength of the material locally where the thinning occurs. Consequently, the overall strength of the can end is reduced as a result.

It will also be appreciated that the material from which can ends are manufactured is never truly homogeneous, exhibiting imperfections and variations in the crystalline or macromolecular structure and the like. Another result of excessive thinning of the material during the drawing and re-forming of the blank to form a can end is to exaggerate imperfections in the original blank material, which may lead to localised failure of the can end. As a result, unless very high quality control systems are put in place, it is hard to maintain the production of such can ends within desired tolerances, such that an unacceptably high number of defective can ends may be produced. However, since the presence or otherwise of imperfections and inhomogeneities in the blank material from which the can ends are made is an entirely random phenomenon, they cannot readily be predicted, and so any can end design or manufacturing process which results in the production of defective can ends in this manner is not acceptable.

It would thus be desirable to provide a method of manufacturing can ends which does not exhibit excessive thinning in the material from which the can end is drawn and re-formed, and can at the same time reduce the quantity of blank material used while maintaining the strength, pressure and failure performance of existing can ends.

SUMMARY OF THE INVENTION

According to a first aspect of the present invention, there is provided a method of forming a can end comprising: holding a peripheral portion of a blank between inner and outer peripheral tool sets; drawing a central portion of the blank against an outer centre panel tool having a central region and a sloping peripheral edge extending to a peripheral wall by moving the outer centre panel tool inwardly relative to the peripheral tool sets to form a drawn can end shell; and reforming the can end shell against an inner centre panel tool having a central region and a peripheral region by moving the inner centre panel tool outwardly relative to the peripheral tool sets to reform the drawn central portion to have a centre panel defined by the central region of the inner centre panel tool and a recessed reinforcing structure extending around the centre panel, wherein the sloping peripheral edge of the outer centre panel tool has a convex radius of curvature of 2 mm or more and 30 mm or less between the central region of the outer centre panel tool and the peripheral wall of the outer centre panel tool.

According to a second aspect of the present invention, there is provided a method of forming a can end comprising: holding a peripheral portion of a blank between inner and outer peripheral tool sets; drawing a central portion of the blank against an outer centre panel tool having a central region and a sloping peripheral edge extending to a peripheral wall by moving the outer centre panel tool inwardly relative to the peripheral tool sets to form a drawn can end shell; and reforming the can end shell against an inner centre panel tool having a central region and a peripheral region by moving the inner centre panel tool outwardly relative to the peripheral tool sets to reform the drawn central portion to have a centre panel defined by the central region of the inner centre panel tool and a recessed reinforcing structure extending around the centre panel, wherein the sloping peripheral edge of the outer centre panel tool has a convex radius of curvature, R1, between the central region of the outer centre panel tool and the peripheral wall of the outer centre panel tool, and the peripheral wall of the outer centre panel tool has a diameter D2, the ratio R1/D2 being 0.025 or more.

According to a third aspect of the present invention, there is provided a method of forming a can end comprising: holding a peripheral portion of a blank between inner and outer peripheral tool sets; drawing a central portion of the blank against an outer centre panel tool having a central region and a sloping peripheral edge extending to a peripheral wall by moving the outer centre panel tool inwardly relative to the peripheral tool sets to form a drawn can end shell; and reforming the can end shell against an inner centre panel tool having a central region and a peripheral region by moving the inner centre panel tool outwardly relative to the peripheral tool sets to reform the drawn central portion to have a centre panel defined by the central region of the inner centre panel tool and a recessed reinforcing structure extending around the centre panel, wherein the sloping peripheral edge of the outer centre panel tool extends between the central region of the outer centre panel tool having a diameter D1 and the peripheral wall of the outer centre panel tool having a diameter D2, the ratio D1/D2 being 0.95 or less.

According to a fourth aspect of the present invention, there is provided a method of forming a can end comprising: holding a peripheral portion of a blank between inner and outer peripheral tool sets; drawing a central portion of the blank against an outer centre panel tool having a central region and a sloping peripheral edge extending to a peripheral wall by moving the outer centre panel tool inwardly relative to the peripheral tool sets to form a drawn can end shell; and reforming the can end shell against an inner centre panel tool having a central region and a peripheral region by moving the inner centre panel tool outwardly relative to the peripheral tool sets to reform the drawn central portion to have a centre panel defined by the central region of the inner centre panel tool and a recessed reinforcing structure extending around the centre panel, wherein the thickness of the reformed material in the recessed reinforcing structure is reduced to no less than or equal to 80% of the original thickness of the blank.

According to a fifth aspect of the present invention, there is provided an apparatus for manufacturing can ends comprising: inner and outer peripheral tool sets arranged for holding a peripheral portion of a blank between; an outer centre panel tool having a central region and a sloping peripheral edge extending to a peripheral wall and movable inwardly relative to the peripheral tool sets for drawing a central portion of a blank held by the inner and outer tool sets against the outer centre panel tool to form a can end shell; and an inner centre panel tool having a central region and a peripheral region movable outwardly relative to the peripheral tool sets for reforming a drawn central portion of a can end shell formed by drawing against the outer centre panel tool into a can end having a centre panel defined by the central region of the inner centre panel tool and a recessed reinforcing structure extending around the centre panel, wherein the sloping peripheral edge of the outer centre panel tool has a convex radius of curvature of 2 mm or more and 30 mm or less between the central region of the outer centre panel tool and the peripheral wall of the outer centre panel tool.

According to a sixth aspect of the present invention, there is provided an apparatus for manufacturing can ends comprising: inner and outer peripheral tool sets arranged for holding a peripheral portion of a blank between; an outer centre panel tool having a central region and a sloping peripheral edge extending to a peripheral wall and movable inwardly relative to the peripheral tool sets for drawing a central portion of a blank held by the inner and outer tool sets against the outer centre panel tool to form a can end shell; and an inner centre panel tool having a central region and a peripheral region movable outwardly relative to the peripheral tool sets for reforming a drawn central portion of a can end shell formed by drawing against the outer centre panel tool into a can end having a centre panel defined by the central region of the inner centre panel tool and a recessed reinforcing structure extending around the centre panel, wherein the sloping peripheral edge of the outer centre panel tool has a convex radius of curvature, R1, between the central region of the outer centre panel tool and the peripheral wall of the outer centre panel tool, and the peripheral wall of the outer centre panel tool has a diameter D2, the ratio R1/D2 being 0.025 or more.

According to a seventh aspect of the present invention, there is provided an apparatus for manufacturing can ends comprising: inner and outer peripheral tool sets arranged for holding a peripheral portion of a blank between; an outer centre panel tool having a central region and a sloping peripheral edge extending to a peripheral wall and movable inwardly relative to the peripheral tool sets for drawing a central portion of a blank held by the inner and outer tool sets against the outer centre panel tool to form a can end shell; and an inner centre panel tool having a central region and a peripheral region movable outwardly relative to the peripheral tool sets for reforming a drawn central portion of a can end shell formed by drawing against the outer centre panel tool into a can end having a centre panel defined by the central region of the inner centre panel tool and a recessed reinforcing structure extending around the centre panel, wherein the sloping peripheral edge of the outer centre panel tool extends between the central region of the outer centre panel tool having a diameter D1 and the peripheral wall of the outer centre panel tool having a diameter D2, the ratio D1/D2 being 0.95 or less.

According to an eighth aspect of the present invention, there is provided a can end shell formed by drawing a sheet metal blank, the can end shell having a drawn central portion and a surrounding peripheral portion, the peripheral portion including a seam and a chuckwall extending radially and axially inwardly from the seam, wherein the drawn central portion is substantially bowl-shaped and has a side wall extending axially and radially inwardly from the chuckwall, the side wall being concavely curved with respect to the axially outer side of the can end shell extending outwardly from a region at the centre of the shell with a radius of curvature on the axially outer side surface of 2 mm or more and 30 mm or less.

According to a ninth aspect of the present invention, there is provided a can end shell formed by drawing a sheet metal blank, the can end shell having a drawn central portion and a surrounding peripheral portion, the peripheral portion including a seam and a chuckwall extending radially and axially inwardly from the seam, wherein the drawn central portion is substantially bowl-shaped and has a side wall extending axially and radially inwardly from the chuckwall, the side wall being concavely curved with respect to the axially outer side of the can end shell extending outwardly from a region at the centre of the shell with a radius of curvature R1 on the axially outer side surface, the bowl shape further including a substantially circular base having a diameter D1, the ratio R1/D1 being 0.028 or more.

According to a tenth aspect of the present invention, there is provided a can end shell formed by drawing a sheet metal blank, the can end shell having a drawn central portion and a surrounding peripheral portion, the peripheral portion including a seam and a chuckwall extending radially and axially inwardly from the seam, wherein the drawn central portion is substantially bowl-shaped and has a side wall extending axially and radially inwardly from the chuckwall, the side wall having a minimum thickness of no less than or equal to 80% of the thickness of the thickest part of the can end shell.

According to an eleventh aspect of the present invention, there is provided a can end formed from a sheet metal blank by drawing the blank to form a can end shell and reforming the can end shell, the can end including a peripheral seam, a chuckwall extending axially and radially inwardly from the seam, a centre panel, and a recessed annular reinforcing structure connected between the centre panel and the chuckwall, wherein the recessed reinforcing structure exhibits a minimum thickness of no less than or equal to 80% of the thickness of the thickest part of the can end.

According to a twelfth aspect of the present invention, there is provided a can end formed from a sheet metal blank by drawing the blank to form a can end shell and reforming the can end shell, the can end including a peripheral seam, a chuckwall extending axially and radially inwardly from the seam, a centre panel, and a recessed annular reinforcing structure connected between the centre panel and the chuckwall, wherein the recessed reinforcing structure is a substantially U-shaped countersink having a radially-outer wall connected to the chuckwall and a radially-inner wall connected to the centre panel, the radially-outer countersink wall being substantially straight and substantially parallel to the can end axis and the radially-inner countersink wall forming a sloping panel wall that extends axially outwardly and radially inwardly from a base of the countersink.

According to a thirteenth aspect of the present invention, there is provided a can end formed from a sheet metal blank by drawing the blank to form a can end shell and reforming the can end shell, the can end including a peripheral seam, a chuckwall extending axially and radially inwardly from the seam, a centre panel, and a recessed annular reinforcing structure connected between the centre panel and the chuckwall, wherein the recessed reinforcing structure is a substantially U-shaped countersink having a radially-outer wall connected to the chuckwall and a radially-inner wall connected to the centre panel, the radially-outer countersink wall being substantially straight and diverging radially and axially outwardly with respect to the can end axis and the radially-inner countersink wall forming a sloping panel wall that extends axially outwardly and radially inwardly from a base of the countersink.

BRIEF DESCRIPTION OF THE DRAWINGS

To enable a better understanding of the present invention, and to show how the same may be carried into effect, reference will now be made, by way of example only, to the accompanying drawings, in which:—

DETAILED DESCRIPTION

In the following description, a can end is formed from a circular blank of material, exhibiting a central axis of rotational symmetry. This axis of the blank corresponds to the central axes of a can end shell and of a can end formed from the blank, and is used throughout the present description to define the axial direction of the blank, of the can end shell, the can end, and a can having the can end attached to a body of the can, as well as to the central axis of the associated tools and tooling by which the can end may be formed. In the embodiments illustrated and described herein, these all have a common central axis.

The upper sides of the can ends shown in FIGS. 1B, 2B, 3B, 4B, 5B, 6B, 7B, 8B, 9B, 10B and 11B correspond to the sides of the can ends which will be exposed, externally, after each can ends has been joined to one axial end of a can body. Similarly, the lower sides of the can ends shown in FIGS. 1B, 2B, 3B, 4B, 5B, 6B, 7B, 8B, 9B, 10B and 11B correspond to the sides of the can ends which will be inside the cans, after each can end has been joined to one axial end of a can body. These two sides of a can end are therefore referred to, correspondingly, as the outer side and the inner side of the can end. Likewise, throughout the present description, references to the outer side or outer axial direction refer to the direction in which outer side of the can end faces, whilst references to the inner side or inner axial direction are references to the direction in which the inner side of the can end faces. The same convention applies when describing the can end shells of FIGS. 1A, 2A, 3A, 4A, 5A, 6A, 7A, 8A, 9A, 10A and 11A.

A similar convention is also used to define the tools and tooling by which the can end according to the present invention may be made. Accordingly, an "inner tool" is a tool which opposes an inner side of a blank or can end shell in order to form the can end, whilst an "outer tool" is a tool which opposes the outer side of the blank or can end shell for forming a can end.

This frame of reference, and such labelling, will be used throughout, unless it is explicitly stated or otherwise clear from the context that a non-axial direction is being described. For example, in the radial direction, perpendicular to the axis, reference will be made to the radially inward and radially outward directions, or to the radially inside or radially outside surfaces of the various features, in which case it is clear that the radial direction, rather than the axial direction, is being described.

Figure 1A:
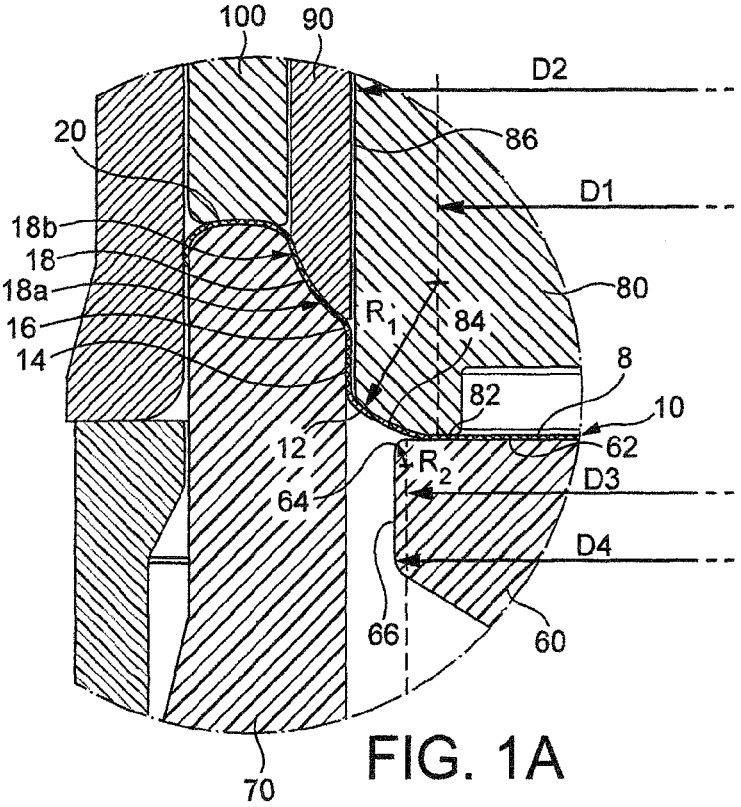
FIG. 1A shows an enlarged view of a peripheral portion of a first embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 1B:
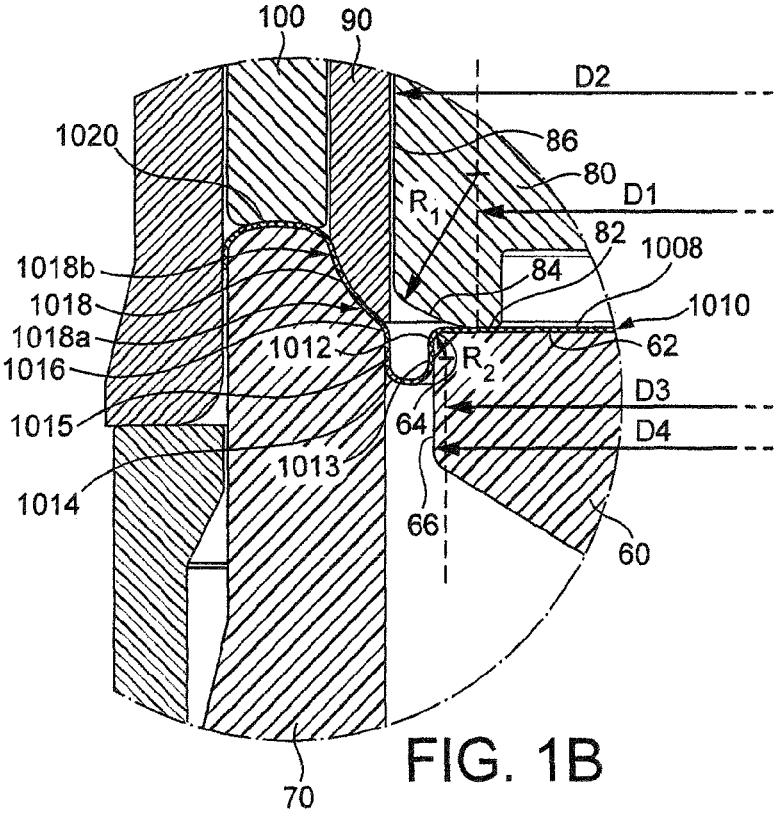
FIG. 1B shows an enlarged view of a peripheral portion of a first embodiment of a can end formed by re-forming the can end shell of FIG. 1A using the inner and outer sets of tools of the can end manufacturing apparatus of FIG. 1A and as also seen in cross-sectional view in a plane which contains the longitudinal axes of the can end and of the opposed inner and outer tooling sets.
Figure 11A:
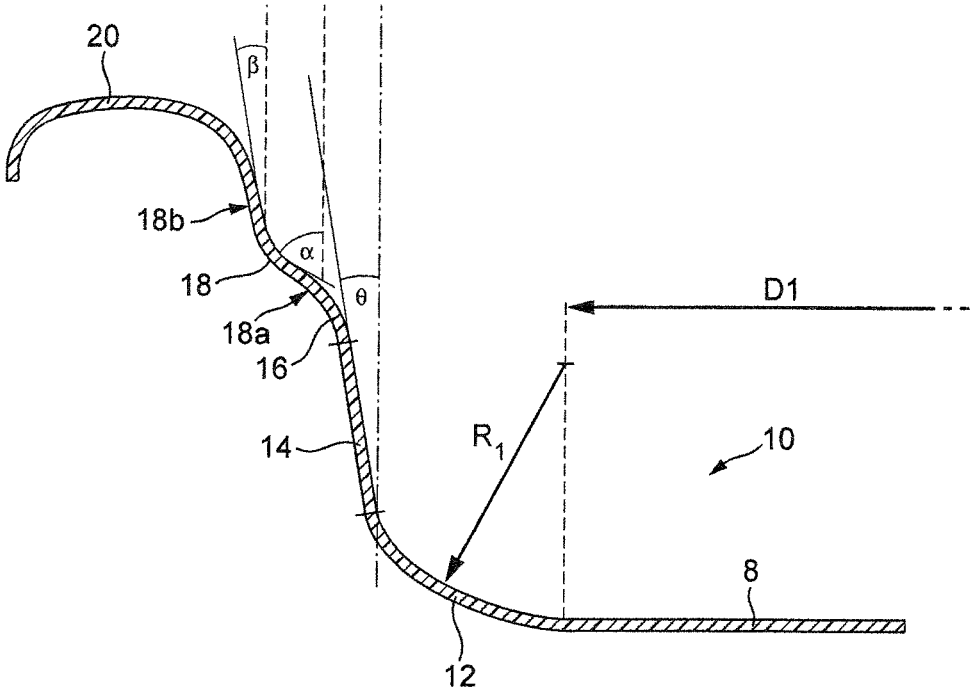
FIG. 11A shows an enlarged view of a peripheral portion of an eleventh embodiment of a can end shell as seen in cross-sectional view in a plane which contains the longitudinal axis of the can end shell and further detailing dimensions of the can end shell.
Figure 11B:
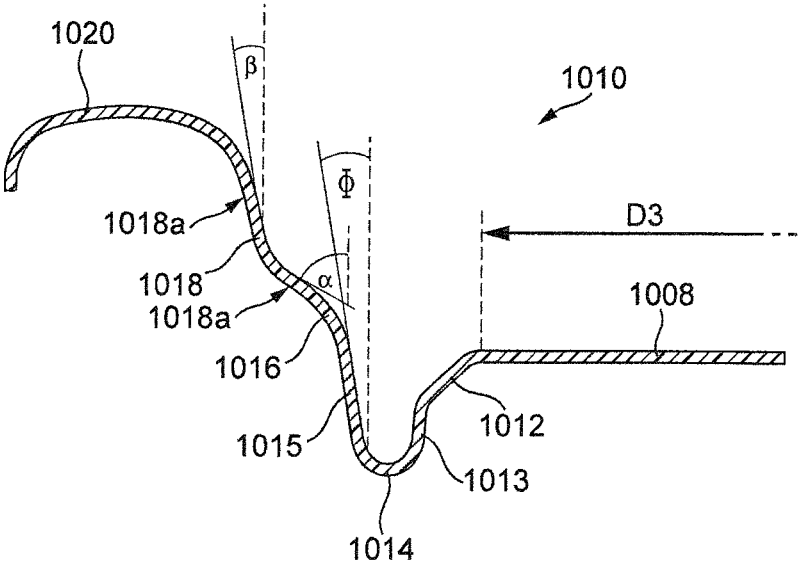
FIG. 11B shows an enlarged view of a peripheral portion of an eleventh embodiment of a can end made by re-forming the can end shell of FIG. 11A, as seen in cross-sectional view in a plane which contains the longitudinal axis of the can end.

Turning to FIGS. 1A and 1B, there are shown two stages in a process of manufacturing a can end according to the present invention. Equivalent two stages of manufacturing processes for further embodiments of the present invention are shown in each of the pairs of FIGS. 2A, 2B; 3A, 3B; 4A, 4B; 5A, 5B; 6A, 6B; 7A, 73; 8A, 8B; 9A, 9B; 10A, 10B; 12A, 12B; and 13A, 13B of the drawing figures, in each case showing the can end shell 10 having been formed between the inner and outer tool sets in the "A" Figure, and showing the re-formed can end 1010 between inner and outer tool sets in the "B" Figure. In FIGS. 11A and 11B, a similar pair of images is given of a can end shell 10, in FIG. 11A, and a can end 1010 made by re-forming the can end shell 10, in FIG. 11B, but without illustrating the associated inner and outer tooling sets.

In all FIGS. 1 to 13, the view given is an enlarged cross-sectional view of the left-hand side of a diametric cross-sectional view of the can end 1010 or can end shell 10, in a plane which includes the axis of rotation of the can end 1010 or can end shell 10. In all of the Figures, the axis of rotation would be vertical on the page, and to the right of the enlarged view as shown. In this connection, the outer side of the can end shell 10, and respectively the can end 1010, is the upper side in each of the drawings figures, whilst the inner side of the can end shell 10 or can end 1010 is the lower side as shown in the figures.

The following description is generally applicable to all of the "A" and "B" Figures of FIGS. 1 to 13.

The can ends are each formed from a blank of sheet material, preferably a circular sheet metal blank. The sheet material may have an initial thickness, prior to drawing and re-forming, of 0.15 mm or more and 0.25 mm or less, more specifically 0.16 mm or more and 0.22 mm or less, more specifically of 0.17 mm or more and 0.21 mm or less, more specifically of 0.18 mm or more and 0.20 mm or less, more specifically of 0.19 mm or less.

A sheet metal blank is typically of aluminium or steel as the sheet material, and may be a 5000 series aluminium alloy.

As shown, but not labelled, on the left-hand side of each of the Figures, the apparatus for manufacturing a can end may include a pair of inner and outer cutting and forming dies, which are responsible for cutting or punching the circular blank out from a larger sheet of material and drawing the blank into a shallow cup shape. Concentrically radially inside this outer pair of cutting and drawing dies is an outer tool set 80, 90, 100 (on the upper side on each of FIGS. 1 to 10); 180, 100 (on the upper side of FIG. 12); 80, 190 (on the upper side of FIG. 13) and an inner tool set 60, 70 (on the lower side in each of FIGS. 1 to 10, 12 and 13).

The inner tool set includes a radially outer inner wall tool 70, and concentrically within it an inner centre panel tool 60. In the outer tool set, an outer centre panel tool 80 opposes the inner centre panel tool 60, the outer centre panel tool 80 being able to move axially inwardly and outwardly relative to the inner wall tool 70, and concentrically radially within the inner wall tool 70.

The outer tooling set typically also includes an outer wall tool including an outer chuckwall tool 90 and an outer seam tool 100, which both oppose the inner wall tool 70. The outer chuckwall tool 90 lies concentrically radially outside the outer centre panel tool 80, and opposes a radially inner portion of the axially outer surface of the inner wall tool 70. An axially inner surface of the outer chuckwall tool 90 cooperates with the axially outer surface of the inner wall tool 70, respectively defining die surfaces which correspond to the desired shape of the outer surface and inner surface of a chuckwall, and being arranged so that when the inner wall tool 70 and outer chuckwall tool 90 compress the blank of sheet material between them, they will press the sheet material so as to define an annular chuckwall structure (chuckwall 18 of the can end shell 10 or chuckwall 1018 of the can end 1010).

Radially outside the outer chuckwall tool 90 is an outer seam tool 100, which opposes a radially outer part of the axially outer face of the inner chuckwall tool 70. In a similar fashion as for the outer chuckwall tool 90, the outer seam tool 100 is arranged with an axially inner surface opposed to an axially outer surface of the inner chuckwall tool 70 so as to compress a peripheral portion of a sheet metal blank between itself and the inner wall tool 70 and thereby to press the blank and define an annular outer seam (seam 20 of the can end shell 10 or seam 1020 of the can end 1010).

The inner and outer wall tools 70, 90, 100 are able to move axially relative to the inner and outer centre panel tools 60, 80.

Again, with general applicability to all of the FIGS. 1 to 13, in a method of forming a can end from a blank sheet of material using the above-described apparatus, the circular blank is initially held between the inner wall tool 70 and at least the outer seam tool 100. The blank is then drawn by moving the outer centre panel tool 80 axially inwardly relative to the inner and outer wall tools 70 and 100, so as to form a can end shell 10, as shown in each of the "A" Figures. For the purposes of the present invention, it is not important whether the outer centre panel tool 80 actually moves radially inwardly or whether the inner wall tool 70 and at least the outer seam tool 100 move axially outwardly, providing that there is a relative movement in the axial direction so as to effect drawing of the blank sheet material.

The can end shell 10 so formed in each case has an outer peripheral portion and an inner central portion. The outer peripheral portion includes a peripheral annular seam 20 connected at its radially inner end to a chuckwall 18 that extends radially and axially inwardly therefrom. Chuckwall 18 is concave with respect to the outer side of the can end shell 10. To this end, the chuckwall 18 has a radially and axially outer end 18*b* and a radially and axially inner end 18*a*, where the inner end 18*a* extends axially and radially outwardly at a greater angle to the axis of rotation of the can end shell 10 than the outer end 18*b*. The chuckwall may be continuously curved between the inner end 18*a* and the outer end 18*b*, in which case it may exhibit a constant or changing radius of curvature, or the chuckwall may be formed of two or more straight-walled sections joined by one or more intermediate bends.

The inner central portion of the can end shell 10 is substantially bowl-shaped and includes a curved sidewall portion that is concave with respect to the outer surface of the can end shell. The inner central portion preferably includes a substantially flat circular base or end panel 8, although there is no base or end panel where the sidewall 12 extends with continuous curvature across the whole diameter of the can end shell. A substantially straight sidewall portion 14, substantially aligned with the axis of rotation of the can end shell 10 or at a slight angle thereto, may be provided extending axially inwardly between the chuckwall 18 and the curved sidewall portion 12. The curved sidewall portion is defined by drawing the circular blank of sheet material against the outer centre panel tool 80, and so the outer side surface of the curved sidewall portion 12 has a radius of curvature substantially equal to the radius of curvature R1 of the peripheral edge 84 of the outer centre panel tool 80, extending radially outwardly from the radially outer edge of the circular base 8, or the centre of the can end shell 10, as the case may be. Likewise, where it is provided, the circular base 8 has an outer diameter on the outer surface substantially equal to D1. A bend 16 which is convex with respect to the outer surface of the can end shell 10 connects the chuckwall inner end 18*a* with the sidewall of the bowl-shaped can end shell inner central portion.

Subsequently to the above-described drawing process, the can end shell 10 as formed in each of the "A" Figures is re-formed by moving the inner centre panel 60 axially outwardly relative to the inner and outer wall tools 70, 90, 100. Again, it is unimportant for the purposes of the present invention whether the axial motion is actually provided by movement of the inner centre panel tool 60 or by movement of the inner and outer wall tools 70, 90, 100, providing that there is a relative axial motion in the direction indicated.

As the reader will appreciate from referring to FIGS. 1 to 10, in the initial stage of holding the peripheral portion of a blank of sheet material between the inner and outer wall tools 70, 90, 100, the blank of sheet material may firstly be held only between the inner wall tool 70 and the outer seam tool 100. The step of drawing the blank to form a can end shell 10 as shown in each of the "A" Figures then involves an essentially two-step process, in the first of which the outer chuckwall tool 90 is moved axially inwardly relative to the inner chuckwall tool 70 (without separately drawing the blank against the outer centre panel tool 80), so as to compress the blank between the outer chuckwall tool 90 and the inner wall tool 70 in order to define the annular chuckwall 18. The outer centre panel tool then moves (or continues to move) axially inwardly relative to the inner wall tool 70 and the outer wall tools 90 and 100 to further draw the blank against the outer centre panel tool 80, so as to reach the position shown in each of the "A" Figures.

As an alternative to this, the initial drawing of the blank may involve drawing the blank against only the outer centre panel tool 80, without engaging the outer chuckwall tool 90 against the inner wall tool 70, so as to draw the blank against the outer centre panel tool 80 before subsequently bringing the outer chuckwall tool 90 into engagement with the inner wall tool 70 to define the chuckwall 18.

In a further alternative, the initial drawing of the blank may be done by moving the outer centre panel tool 80 simultaneously with the outer chuckwall tool 90, so as to draw the blank concomitantly around both the outer centre panel tool 80 and the outer chuckwall tool 90, until the outer chuckwall tool 90 reaches its limit of motion where it compresses the blank against the inner wall tool 70 to form chuckwall 18. After this, there will continue a further axial motion of the inner centre panel tool 80 in order to bring it into the position shown in each of the "A" Figures of FIGS. 1 to 10.

In each case, during the subsequent step of re-forming the can end shell 10 produced in each of the "A" Figures, the outer chuckwall tool 90 remains in compressive engagement with the inner wall tool 70, during the re-forming process.

As regards the inner and outer centre panel tools 60 and 80, these may be capable of independent motion, such that the drawing of the blank to form the can end shell 10 requires only motion of the outer centre panel tool 80 and the re-forming of the can end shell 10 to form the can end 1010 requires only motion of the inner centre panel tool 60. However, it is normally preferable for the inner and outer centre panel tools 60 and 80 to cooperate so as to hold the central portion of the blank or drawn can end shell 10 between the inner and outer centre panel tools 60 and 80 during both the initial can shell drawing operation against the outer centre panel tool 80 and the subsequent re-forming operation against the inner centre panel tool 60.

In further alternatives, methods according to the present invention may be carried out by a manufacturing apparatus having a variation on the tooling arrangement described above.

In a first such variation, the outer centre panel tool 80 and the outer chuck wall tool 90 may be combined into a single tool 180 or otherwise arranged to move together with equivalent effect. In the case of the combined outer panel and chuckwall tool 180, the outer peripheral part of the tool 180 corresponding to the outer chuckwall tool 90 has an inner axial end face which opposes the outer axial end face of the inner wall tool 70, in like manner as for the outer chuckwall tool 90. This arrangement is suited to instances where it is desired to limit the complexity of the apparatus, or when the chuckwall 18, 1018 is intended to be steep, i.e., relatively closely aligned with the axis of rotation. When the chuckwall is steep, the diameter of the inner end 18*a* of the chuckwall is close to the diameter of the outer end 18*b* of the chuckwall 18, and the cross-sectional thickness of a separate outer chuck wall tool 90 may become thin and weak. At the same time, when the chuckwall 18 is sufficiently steep it may be able to resist deformation under axial compression, such that it is not necessary for an outer chuckwall tool 90 to press against the outer surface of the chuck wall 18 during the re-forming process. Accordingly, it may then be preferable for the outer chuckwall tool 90 to move in combination with the outer centre panel tool 80, or for these tools to be combined into a single outer panel and chuckwall tool 180.

The method of manufacturing a can end using such a combined outer panel and chuckwall tool 180 is substantially unaltered from that described above. A circular blank of sheet material is initially held between the inner wall tool 70 and outer seam tool 100. The combined outer panel and chuckwall tool 180, or the pair of an outer chuckwall tool 90 and outer centre panel tool 80 arranged to move together, is then moved axially inwardly relative to the inner wall tool 70 and outer seam tool 100 to draw the blank into a can end shell 10. The can end shell is then re-formed against the inner centre panel tool 60 by moving the inner centre panel tool 60 axially outwardly relative to the inner wall tool 70 and outer seam tool 100. The combined outer panel and chuckwall tool 180, or the pair of an outer chuckwall tool 90 and outer centre panel tool 80 arranged to move together, may be moved axially outwardly before re-forming the can end shell 10 against the inner centre panel tool 60, but in most cases will be arranged to move axially outwardly together with the inner centre panel tool 60 so as to hold the central portion of the can end shell 10 compressively between the inner and outer circular end faces 62 and 82 during the re-forming.

In a second such variation, the outer chuckwall tool 90 and the outer seam tool 100 may be combined into a single tool 190, or otherwise arranged to move together with equivalent effect. This arrangement may again be suited to instances where it is desired to limit the complexity of the apparatus, or when the chuckwall 18, 1018 is intended to be steep, i.e., relatively closely aligned with the axis of rotation. When the chuckwall is steep, the diameter of the inner end 18*a* of the chuckwall 18 is close to the diameter of the outer end 18*b* of the chuckwall 18, and the cross-sectional thickness of a separate outer chuck wall tool 90 may become thin and weak. Accordingly, it may then be preferable for the outer chuckwall tool 90 to move in combination with the outer seam tool 100, or for these tools to be combined into a single outer wall tool 190. At the same time, combining the outer seam tool 100 and outer chuckwall tool 90, or arranging these to move together, permits the chuckwall 18 still to be held against axial compression by the inner axial face of the outer chuckwall tool 90 or the combined outer wall tool 190, so as to resist axial compression during re-forming of the can end shell 10 against the inner centre panel tool 60.

Again, the method of manufacturing a can end using such a combined outer panel and chuckwall tool 180 is substantially unaltered from the methods described above. A circular blank of sheet material is initially held between the inner wall tool 70 and the combined outer wall tool 190 or the pair of outer seam tool 100 and outer chuckwall tool 90 arranged to move together. The outer centre panel tool 80 is then moved axially inwardly relative to the inner wall tool 70 and the combined outer wall tool 190, or the pair of outer seam tool 100 and outer chuckwall tool 90 arranged to move together, to draw the blank into a can end shell 10. The can end shell is then re-formed against the inner centre panel tool 60 by moving the inner centre panel tool 60 axially outwardly relative to the inner wall tool 70 and and the combined outer wall tool 190 or the pair of outer seam tool 100 and outer chuckwall tool 90 arranged to move together. The outer centre panel tool 80 may be moved axially outwardly before re-forming the can end shell 10 against the inner centre panel tool 60, but in most cases will be arranged to move axially outwardly together with the inner centre panel tool 60 so as to hold the central portion of the can end shell 10 compressively between the inner and outer circular end faces 62 and 82 during the re-forming.

In general, the inner centre panel tool 60 has a substantially flat, circular axially outer end face 62 having an outer diameter D3, with a sloping peripheral surface 64 extending radially outwardly and axially inwardly therefrom. The sloping peripheral surface 64 may be convexly curved with respect to the axially outer side, in which case it may have a varying curvature or a constant radius of curvature. The convexly curved sloping peripheral wall 64 extends radially outwardly from the outer peripheral edge of the substantially flat circular end face 62 with a radius of curvature R2. Equally, the sloping peripheral edge 64 may include a straight-walled section or even a section that is concavely curved. An annular groove 65 may surround the sloping peripheral wall 64 adjacent to the cylindrical outer peripheral wall 66 of the inner centre panel tool 60, or a gap may be provided between the cylindrical outer peripheral wall 66 of the inner centre panel tool 60 and the cylindrical inner peripheral wall of the inner wall tool 70. The cylindrical outer peripheral wall 66 of the inner centre panel tool 60 has an outer diameter D4.

Likewise, the outer centre panel tool 80 is generally formed to have a substantially flat annular circular axially inner end face 82 having an outer diameter D1, with a sloping peripheral surface 84 extending radially and axially outwardly therefrom. The sloping peripheral surface 84 may be convexly curved with respect to the axially inner side, in which case it may have a varying curvature or a constant radius of curvature. The convexly curved sloping peripheral wall 84 extends radially outwardly from the outer peripheral edge of the substantially flat annular circular end face 82 with a radius of curvature R1. Equally, the sloping peripheral edge 84 may include a straight-walled section or even a section that is concavely curved. The outer centre panel tool 80 has a cylindrical outer peripheral wall 86 with an outer diameter D2.

One important feature in the disclosed embodiments described in more detail below is the shape of the outer centre panel tool 80. More specifically, the outer centre panel tool 80 has a radiused peripheral edge portion 84 extending radially outwardly from a central portion 82 of its axially inner face. As shown in the drawings, the central portion 82 of the axially inner face of the outer centre panel tool 80 is formed as an annular, substantially flat, circular portion, having a recess formed radially within it. For example, this recess may be used to accommodate features such as ventilation and screw holes, where they will not come into contact with or otherwise cause damage to the can end shell outer surface.

Nevertheless, it will be appreciated that the axially inner surface of the outer centre panel tool 80 could be formed as a flat circular piece with no radially inner recess. It will equally be appreciated that there is no requirement for the outer centre panel tool 80 have a flat central portion 82, as the present invention contemplates an outer centre panel tool whose axially inner surface is domed with continuous curvature across the whole diameter of the inner face.

Even so, in the contemplated embodiments, a circular central region 82 is provided, with the curved annular radiused portion 84 extending radially outwardly from the flat central portion 82. The curved radiused portion 84 extends tangentially outwardly from the circular central portion 82, and has a radius of curvature R1 in the cross-sectional plane shown in each of FIGS. 1 to 11. It is presently contemplated for the curved surface 84 to have a constant radius of curvature R1, although the present invention is not limited to this, and an increasing or decreasing radius of curvature extending radially outwardly from the circular centre region 82 would also be possible.

The intention is for the radius of curvature R1 to be significantly larger than in known prior art can end manufacturing apparatuses, in order to reduce the tendency for the material of the blank to become subjected to thinning during the drawing process. In typical prior art tooling, the equivalent of the outer centre panel tool 80 has a sharp radius at its outer circumferential edge. The effect of this is that, during the drawing operation, the material of the blank cannot readily flow around the radiused edge corner, such that the material instead becomes stretched, consequently leading to thinning of the material. By providing a larger radius of curvature R1 than is conventionally used in such tooling, thinning of the blank material can be inhibited during the drawing process.

Furthermore, and as may partly result from the reduction in thinning during drawing of the can end shell 10 and also as a result of the shape of the curved annular radiused portion 84 of the outer centre panel tool 80, the curved sidewall 12 contains a greater volume of material than would be contained in the equivalent axially projected flat region that is typical of the prior art can end shells. This greater volume of material has to be displaced in order to re-form the can end shell 10 into a can end 1010, and it is believed that one consequence of this is to cause the material in the curved sidewall 12 to be pushed radially outwardly by the inner centre panel tool 60 during re-forming of can end shell sidewall to form the recessed annular reinforcing structure.

By acting to push the material radially outwardly into the recessed annular reinforcing structure, thinning of the material in the recessed annular reinforcing structure can be reduced or prevented. This is in direct contrast to the effect experienced using conventional upper centre panel tools, where the compression of the can end shell against the inner centre panel tool causes the inner centre panel tool to pull the end panel of the can end shell back on itself under tension, this tension leading to further thinning of the material in the recessed annular reinforcing structure.

Figure 14A:
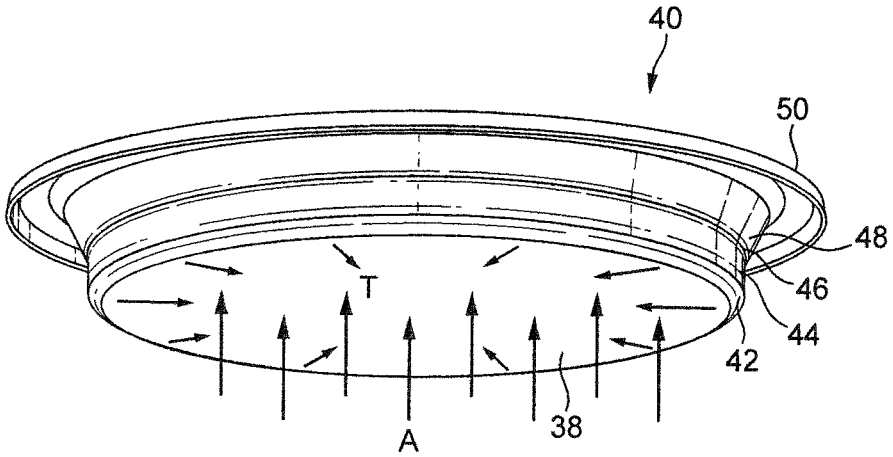
FIG. 14A shows a perspective view from the axially inner, radially outer side of a conventional can end shell, illustrating schematically how radial tensile forces may be generated in the periphery of the end panel when axially compressing the can end shell against an inner centre panel tool during re-forming.
Figure 14B:
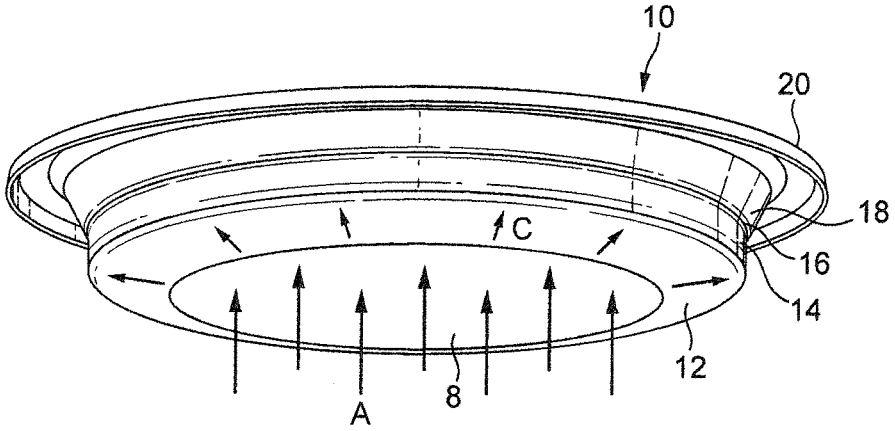
FIG. 14B shows a perspective view from the axially inner, radially outer side of a can end shell formed in accordance with the present invention, illustrating schematically how radial compressive forces may be generated in the periphery of the end panel when axially compressing the can end shell against an inner centre panel tool during re-forming.

This effect is illustrated in FIGS. 14A and 14B. In FIG. 14A, a can end shell 40 of conventional design is shown, having an outer peripheral seam 50, a chuckwall 48 extending axially and radially inwardly from the peripheral seam, a vertical sidewall portion 44 connected to the chuckwall 48 by an outwardly convex bend 46, and a circular end panel or base connected to the vertical sidewall portion 44 by an outwardly concave bend 42. Axial arrows A in FIG. 14A represent the compressive forces applied to the end panel 38 of the can end shell 40 during re-forming against an inner centre panel tool. Radial arrows T show how this draws the material at the periphery of the end panel 38 into tension, which may result in further thinning of the material during re-forming.

In FIG. 14B, a can end shell 10 formed in accordance with the present invention is shown, having an outer peripheral seam 20, a chuckwall 18 extending axially and radially inwardly from the peripheral seam, a vertical sidewall portion 14 connected to the chuckwall 18 by an outwardly convex bend 16, and a circular end panel or base 8 connected to the vertical sidewall portion 14 by an outwardly concave curved sidewall portion 12. Axial arrows A in FIG. 14B represent the compressive forces applied to the end panel 8 of the can end shell 10 during re-forming against an inner centre panel tool. Radial arrows C show how this pushes the material at the periphery of the end panel 8 radially outwardly under compression, which may reduce thinning of the material during re-forming.

Additionally to showing tensile and compressive forces, respectively, the arrows T and C may also represent the general direction of material flow at the peripheral edges of the end panels 38 and 8, respectively, during re-forming of the can end shells 40 and 10.

As a result, by using the method and apparatus of the present invention, the thickness of the re-formed material in the recessed reinforcing structure may be reduced to no less than or equal to 80% of the original thickness of the blank. Preferably, the thickness of the re-formed material in the recessed reinforcing structure is reduced to no less than or equal to 85%, preferably no less than or equal to 90%, more preferably no less than or equal to 95%, of the original thickness of the blank.

In the can end shell 10, the sidewall 12, 14 may having a minimum thickness of no less than or equal to 80% of the thickness of the thickest part of the can end shell 10. Preferably the sidewall 12, 14 has a minimum thickness of no less than or equal to 85%, preferably no less than or equal to 90%, more preferably no less than or equal to 95%, of the thickness of the thickest part of the can end shell 10.

In the can end 1010, the recessed reinforcing structure may exhibit a minimum thickness of no less than or equal to 80% of the thickness of the thickest part of the can end 1010. Preferably, the recessed reinforcing structure has a minimum thickness of no less than or equal to 85%, preferably no less than or equal to 90%, more preferably no less than or equal to 95%, of the thickness of the thickest part of the can end.

Also important in defining the present invention may be the values of the radii of curvature R1 and R2; the ratio between the radius of curvature R1 of the sloping peripheral wall 84 and the diameter D1 of the circular end face 82 of the outer centre panel tool 80; the ratio of the diameter D1 of the circular end face 82 to the diameter D2 of the cylindrical outer peripheral wall 86 of the outer centre panel tool 80; the ratio between the radius of curvature R2 of the sloping peripheral wall 64 and the diameter D3 of the circular end face 62 of the inner centre panel tool 60; and the ratio of the diameter D3 of the circular end face 62 to the diameter D4 of the cylindrical outer peripheral wall 66 of the inner centre panel tool 60.

In this respect, R1 may be in the range from 2 mm or more to 30 mm or less. More specifically, R1 may lie in the ranges from 3 mm or more to 25 mm or less, more specifically from 4 mm or more to 20 mm or less, even more specifically from 5 mm or more to 15 mm or less, extending between the annular circular axially inner face 82 of the outer centre panel tool 80 and the peripheral wall 86 of the outer centre panel tool 80.

Similarly, R2 may be in the range from 2 mm or more and 30 mm or less, more specifically 3 mm or more and 25 mm or less, more specifically 4 mm or more and 20 mm or less, even more specifically 5 mm or more and 15 mm or less, extending from the circular axially outer face 62 of the inner centre panel tool 60.

The ratio R1/D2 may be in the range of 0.025 or more. More specifically the ratio R1/D2 may be in the range of 0.03 or more and 0.5 or less, more specifically 0.06 or more and 0.4 or less, more specifically 0.1 or more and 0.3 or less.

The ratio D1/D2 may be in the range of 0.95 or less. More specifically, the ratio D1/D2 may be in the range of 0.92 or less and 0.5 or more, more specifically 0.9 or less and 0.6 or more, even more specifically 0.8 or less and 0.6 or more.

The ratio R2/D4 may be in the range of 0.025 or more. More specifically, the ratio R2/D4 may be in the range of 0.03 or more and 0.5 or less, more specifically 0.06 or more and 0.4 or less, even more specifically 0.1 or more and 0.3 or less.

The ratio D3/D4 may be in the range of 0.95 or less. More specifically, the ratio D3/D4 may be in the range of 0.92 or less and 0.5 or more, more specifically 0.9 or less and 0.6 or more, more even more specifically 0.8 or less and 0.6 or more.

It will particularly be appreciated by comparing the "A" Figures with each of the "B" Figures, that the benefit of this is not only to reduce thinning in general, but, specifically, to reduce thinning in the region of the can end shell that is subsequently re-formed to create a recessed annular reinforcing structure (typically a countersink or annular bead surrounding the centre panel of the can end), which is the structure responsible for providing strength to the can end. Accordingly, by reducing thinning of the material in the recessed reinforcing structure, the overall strength of the can end can be significantly increased. Equivalently, for a given strength requirement, the thickness of the blank material needed to produce the can end can be reduced.

In this connection, as a general rule, a can end formed in accordance with the present invention, when seamed onto the end of a can body filled with a carbonated beverage, may be able to withstand an internal pressure of at least 85 psi, more preferably at least 90 psi.

The can end 1010 formed in each case has an outer peripheral portion that is typically substantially unaltered from the outer peripheral portion of the can end shell, and in any event includes a peripheral annular seam 1020 connected at its radially inner end to a chuckwall 1018 that extends radially and axially inwardly therefrom. Chuckwall 1018 is concave with respect to the outer side of the can end 1010. To this end, the chuckwall 1018 has a radially and axially outer end 1018*b* and a radially and axially inner end 1018*a*, where the inner end 1018*a* extends axially and radially outwardly at a greater angle to the axis of rotation of the can end 1010 than the outer end 1018*b*. The chuckwall 1018 may be continuously curved between the inner end 1018*a* and the outer end 1018*b*, in which case it may exhibit a constant or changing radius of curvature, or the chuckwall may be formed of two or more straight-walled sections joined by one or more intermediate bends.

During the re-forming process, the inner central portion of the can end shell is re-formed to provide the can end 1010 with a domed central structure having a substantially flat circular centre panel 1008 with a sloping peripheral panel wall 1012 extending radially outwardly and axially inwardly from the peripheral edge of the centre panel 1008. The sloping peripheral panel wall 1012 is defined by the shape of the outer surface of the inner centre panel tool 60, and is typically convexly curved with respect to the outer side of the can end 1010, but may include a straight-walled or concavely curved section. Where the outer peripheral edge 64 of the inner centre panel tool 60 is radiused with Radius of curvature R2, the inner surface of the sloping panel wall will have a radius of curvature substantially equal to R2. Similarly, the inner surface of the centre panel 1008 will have an outer diameter that is equal to the outer diameter D3 of the axially outer circular end face 62 of the inner centre panel tool 60.

A recessed reinforcing structure surrounds the centre panel 1008 and is connected thereto by the sloping panel wall 1012, which may form part of the recessed reinforcing structure. The recessed reinforcing structure may take the form of a countersink. In this case, the countersink may include the sloping panel wall 1012 as a radially inner countersink wall, or the sloping panel wall 1012 may serve as a panel radius which connects an inner countersink wall 1013 to the circular centre panel 1008. The countersink also includes a radially outer countersink wall 1015 connected to the sloping panel wall 1012 or the inner countersink wall 1013, as the case may be, by a curved countersink base 1014. The curved countersink base 1014 may be continuously curved across the width of the countersink, may have a changing radius of curvature, or may include one or more straight-walled segments connected by bends. A concave bend 1016 connects the radially outer countersink wall 1015 to the inner end 1018*a* of the chuckwall 1018.

Alternatively, the recessed reinforcing structure may include one or more annular beads connected to the axially inner end of the sloping panel wall, which may include an annular bead 1002 that is concave with respect to the outer side of the can end 1010. The bead 1002 may also be concave facing in the radially inward direction. A further annular bead 1004 may also be provided, connected to the axially outer end of the bead 1002, and being convex with respect to the outer side of the can end 1010. Annular bead 1004 may also be convex facing in the radially inward direction, and connects the concave annular bead 1002 with the inner end 1018*a* of the chuckwall 1018.

It can thus be seen that, by using the method and apparatus of the present invention, thinning of the material, in particular in the region of the recessed reinforcing structure of the can end, can improve the overall strength of the can end. This may apply equally to known designs of can ends, as well as to new designs of can ends which are made feasible by virtue of this invention.

It will also be appreciated that the shape of the outer centre panel tool 82 is not alone responsible for benefits arising out of the present invention. The improved design of outer centre panel tool 82 also operates favourably in conjunction with the design of chuckwall 18 which is outwardly concave as described above. It will be appreciated that an outwardly concave chuckwall 18, 1018 is not required, however, and the chuckwall may be entirely straight or even concave with respect to the outer side of the can end shell or can end 1010, within the scope of the present invention.

As already mentioned above, and as seen in FIGS. 1 to 13, the shape of the chuckwall does not change substantially during the re-forming process, and remains substantially the same for the chuckwall 1018 of the can end 1010 of the "B" Figures as for the chuckwall 18 of the drawn can end shell 10 of the "A" Figures.

A beneficial feature of the chuckwall design in each of FIGS. 1 to 11 is that the chuckwall 18, 1018 is concave with respect to the outer surface of the can end 10 or can end shell 1010. Expressed another way, the radially and axially outer end 18*b*, 1018*b* of the chuckwall 18, 1018 is more vertical (i.e., more closely aligned with, or at a smaller angle to, the axis of the can end shell/can end/tooling), whereas the radially and axially inner end 18*a*, 1018*a* of the chuckwall 18, 1018 is angled at a greater degree to the vertical (i.e., at a larger angle to the axis of the can end shell/can end/tooling). Such a concave shape may be achieved by providing a curved chuckwall 18, 1018 extending with continuous curvature between the radially inner end 18*a*, 1018*a* and radially outer end 18*b*, 1018*b*, or by having a chuckwall 18, 1018 with two or more substantially straight sections joined by one or more bends or curved portions.

Forming the chuckwall 18 with such a shape may be beneficial for the step of re-forming the can end shell 10, as the change in curvature between the chuckwall 18, being concave with respect to the outer side of the can end shell 10, and the bend 16 at the radially inner end 18*a* of the chuckwall 18, which leads into the sidewall of the central portion of the can end shell 10 that has been drawn by the outer centre panel tool 80, provides strength in the axial direction to resist compression as the can end shell 10 is re-formed against the inner centre panel tool 60. This enables the can end shell 10 to be substantially freely re-formed in the region peripheral to the centre panel 1008 of the can end 1010, so as to adopt the desired shape of the recessed reinforcing structure.

Furthermore, because of the reduced thinning of the blank material, or, alternatively due to or coupled with the improved re-formability of the can end shell 10 due to the shape of the chuckwall 18, new designs of can end 1010 become plausible, which provide the necessary strength to the can end 1010 to withstand the internal pressures experienced by the carbonated beverage can during production and handling. Some such designs were not previously considered as being suitable, due to the recessed reinforcing structure not appearing to provide the necessary strength as a result of thinning or otherwise, but are enabled by the method and apparatus disclosed herein.

One possible benefit with such structures is that the shape of the recessed reinforcing structure can be simplified, whilst providing the necessary strength to the can end 1010. Not only can the structure be made less complicated (i.e., in view of having fewer bends, curves or other specific shapes, thereby requiring less processing of the blank material), but also the amount of material which is required in the blank can be reduced, since it does not have to be formed into these complex structures. As a result, a smaller diameter of circular blank material can be used in order to manufacture the can end, thus saving on material costs as compared with known and conventional can end designs. This is an additional material saving to that which is obtainable from reducing the gauge of the blank material, i.e., by using a thinner sheet of material.

It should, however, be understood that nothing in the above excludes the possibility of providing such additional structures to the can end shells 10 or can ends 1010 of the present invention, as may be desirable for improving and/or controlling the pressure performance of the can end 1010, as is already well known in the present technical field.

Turning now to the specific examples shown in FIGS. 1 to 11, a first embodiment of the invention is disclosed in FIGS. 1A and 1B.

FIG. 1A shows a can end shell 10 which has been drawn from a circular blank of sheet material between inner and outer tool sets. As described above, the inner tool set includes an inner centre panel tool 60, and an inner wall tool 70 disposed concentrically radially outside the inner centre panel tool 60. Inner centre panel tool 60 has a substantially flat circular axially outer surface 62, joined to the radially outer wall 66 by an annular radiused corner 64 having a radius of curvature R2. A predefined gap exists between the radially outer peripheral wall 66 of the inner centre panel tool 60, having a diameter D4, and the radially inner wall of the inner wall tool 70, into which gap the can end shell 10 can be re-formed so as to define a countersink of the can end 1010. As there is no corresponding forming surface of the inner centre panel tool 60 in this region, the countersink is freely re-formed in the peripheral annular gap between the inner centre panel tool 60 and the inner wall tool 70.

The outer tool set includes an outer centre panel tool 80, an outer chuckwall tool 90 concentrically surrounding the outer centre panel tool 80, and an outer seam tool 100 concentrically surrounding the outer chuckwall tool 90. The outer centre panel tool 80 opposes the inner centre panel tool 60, and has a substantially flat axially inner surface 82 formed as a circular annulus, which operably comes into contact with the axially outer surface 62 of the inner centre panel tool 60 for holding the central portion of a blank or a can end shell between the inner and outer centre panel tools 60, 80. The outer centre panel tool 80 has a curved wall 84 extending radially outwardly from the circular annular axially inner face 82 with a radius of curvature R1. In the Example of FIG. 1A, the curved annular wall 84 has a constant radius of curvature R1, extending to the outer peripheral wall 86 of the outer centre panel tool 80. As can be appreciated from FIG. 1A, the radius of curvature R1 of the outer centre panel tool 80 is significantly larger than the radius of curvature R2 at the peripheral edge 64 of the axially outer end 62 of the inner centre panel tool 60.

As can be seen in FIG. 1A, the radially outer peripheral wall 86 of the outer centre panel tool 80 has a smaller diameter D2 than the inner peripheral wall of the inner wall tool 70, thus permitting the outer centre panel tool 80 to slide axially within the inner wall tool 70.

The outer chuckwall tool 90 and the outer seam tool 100 oppose the inner wall tool 70. The inner wall tool 70 has an axially outer surface which cooperates with the axially inner surfaces of the outer chuckwall tool 90 and the outer seam tool 100. The inner axial surface of the outer seam tool 100 cooperates with the outer axial surface of the inner wall 70 to define a seam 20 of the can end shell 10. Similarly, concentrically radially inside the outer seam tool 100, the outer chuckwall tool 90 has an inner axial surface which cooperates with the axially outer surface of the inner wall tool 70 to define a chuckwall 18 of the can end shell 10.

In this embodiment, the chuckwall is curved between its axially inner end 18*a* and its axially outer end 18*b* with a substantially constant radius of curvature. More specifically, in this example, the curvature of the inner axial surface of the outer chuckwall tool 90 is a continuation of the curvature of the curved annular wall 84 of the outer centre panel tool 80. Thus, when the outer centre panel tool 80 and the outer chuckwall tool 90 are aligned, the curved axially inner surface of the outer chuckwall tool 90 has the same centre of curvature as the curved radiused wall 84 of the outer chuckwall tool 80.

The outer centre panel tool 80 has an outer peripheral wall 86 with a diameter D2 which is only marginally smaller than the diameter of the inner peripheral wall of the inner wall tool 70, such that when the inner centre panel tool 80 is drawn axially inwardly relative to the inner wall tool 70, as shown in FIG. 1A, the can end shell 10 is formed with a bend 16 between the chuckwall 18 and a vertical sidewall portion 14 which extends substantially parallel to the axis of the can end shell/tools. The bowl-shaped central portion of the can end shell 10 thus includes a vertical or axially aligned wall portion 14 and a curved sidewall portion 12 with a curved outer surface having a radius of curvature substantially equal to the radius of curvature R1 of the outer curved wall 84 of the outer centre panel tool 80.

The bowl-shaped central portion of the can end shell 10 also includes a substantially circular base 8, whose outer extent is defined by the outer edge of the flat circular annulus 82 of the inner axial face of the outer centre panel tool 80. The circular base 8 of the can end shell 10 has a diameter D1 which is the same as the outer diameter of the inner axial circular annulus 82. Since the curved outer edge 84 of the outer centre panel tool 80 extends from the substantially flat annular surface 82 initially tangentially, the centre of curvature of the radius R1 also lies on a line parallel to the axis of rotation of the can end shell 10 corresponding to the diameter D1, as shown in FIG. 1A.

Moving from FIG. 1A to FIG. 1B, it can be seen that the inner centre panel tool 60 is moved axially outwardly relative to the inner and outer wall tools 70, 90 and 100, so as to re-form the bowl-shaped inner portion of the can end shell 10 to define a can end 1010 having an outer peripheral seam 1020, a chuckwall 1018 extending axially and radially inwardly from the seam 1020, a centre panel 1008, and a countersink extending between the chuckwall 1018 and the centre panel 1008. The countersink has a radially inner countersink wall 1013 and a radially outer countersink wall 1015 connected to each other by a curved countersink base 1014. The radially inner countersink wall 1013 is connected to the centre panel 1008 by a panel radius 1012, having a radius of curvature at its inner surface substantially equal to the radius R2 at the peripheral edge 64 of the inner centre panel tool 60. The radially outer countersink wall 15 is connected to the curved chuckwall 1018 by a bend 1016. Whereas the curvature of the countersink wall 1018 is concave with respect to the outer side of the can end 1010, the bend 1016 has a curvature which is convex with respect to the outer side of the can end 1010.

It will be appreciated that the inner centre panel tool 60 of FIG. 1B provides no structure between its radially outer peripheral edge 66 and the radially inner peripheral wall of the inner wall tool 70, such that the countersink is freely formed in the peripheral gap between the inner wall tool 70 and the inner centre panel tool 60. The curved base 1014 of the countersink will thus be substantially continuously curved between the radially inner countersink wall 1013 and the radially outer countersink wall 1015. However, the shape of the curved base 1014 of the countersink may instead be controlled by providing an appropriate forming structure on the outer periphery of the inner centre panel tool 60, or by providing a separate, concentric tool between the inner centre panel tool 60 and inner wall tool 70, if desired.

In the embodiment of FIGS. 1A and 1B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 0.46 mm, more generally from 0.45 mm to 0.5 mm, more generally from 0.4 mm to 0.6 mm.

D3 is equal to or approximately equal to 43.92 mm, more generally from 43 mm to 44 mm, more generally from 42.5 mm to 45 mm, more generally from 40 mm to 50 mm.

D4 is equal to or approximately equal to 44.8 mm, more generally from 44 mm to 45 mm, more generally from 43 mm to 46 mm, more generally from 40 mm to 55 mm.

R1/D2 is equal to or approximately equal to 0.096, more generally from 0.09 to 0.1, more generally from 0.08 to 0.25, more generally from 0.05 to 0.5.

R2/D4 is equal to or approximately equal to 0.01, more generally from 0.009 to 0.015, more generally from 0.008 to 0.025.

D1/D2 is equal to or approximately equal to 0.86, more generally from 0.85 to 0.9, more generally from 0.8 to 0.95.

D3/D4 is equal to or approximately equal to 0.98, more generally from 0.95 to 0.99.

Figure 2A:
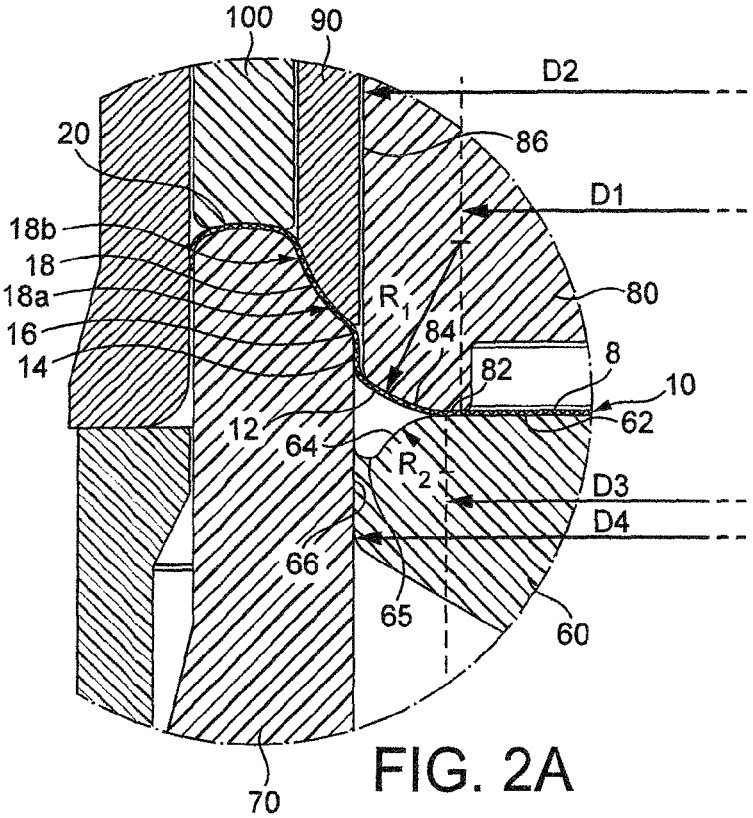
FIG. 2A shows an enlarged view of a peripheral portion of a second embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 2B:
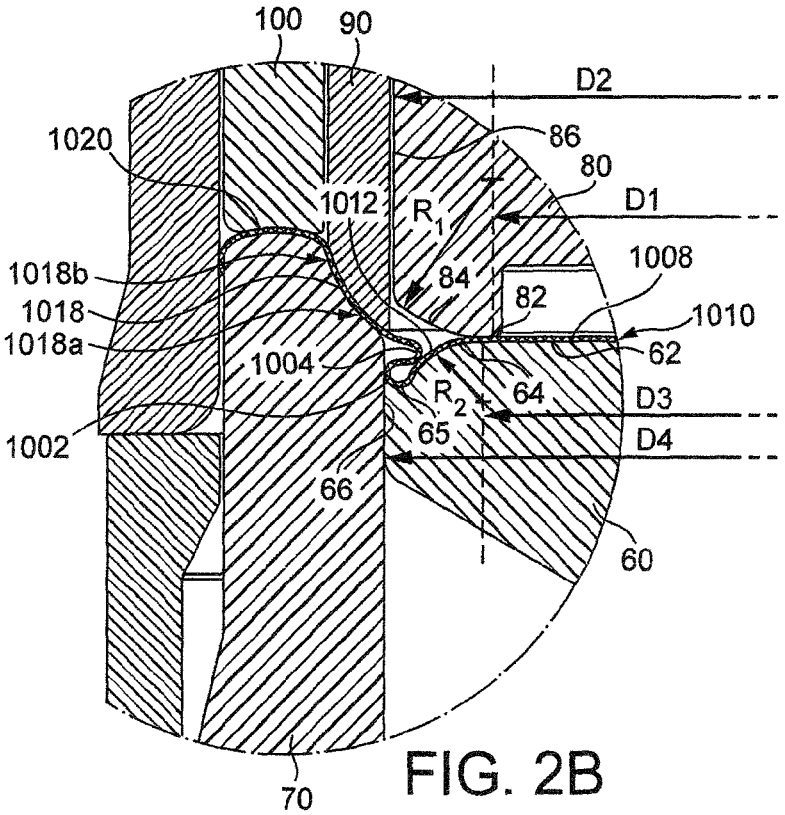
FIG. 2B shows an enlarged view of a peripheral portion of a second embodiment of a can end formed by re-forming the can end shell of FIG. 2A using the inner and outer sets of tools of the can end manufacturing apparatus of FIG. 2A and as also seen in cross-sectional view in a plane which contains the longitudinal axes of the can end and of the opposed inner and outer tooling sets.

Turning to FIG. 2A, there is shown an example of a can end shell 10 drawn from a sheet material blank in substantially the same manner as the can end shell 10 of FIG. 1A, while FIG. 2B shows a can end 1010 re-formed from the can end shell 10 against a different design of centre panel tool 60. Accordingly, the relevant description given for FIGS. 1A and 1B above applies equivalently for FIGS. 2A and 2B.

In FIGS. 2A and 2B, the tooling is substantially the same as the tooling in FIGS. 1A and 1B, with the exception of the inner centre panel tool 60. Accordingly, the can end shell 10 of FIG. 2A is substantially identical with the can end shell 10 of FIG. 1A with the exception that it has been drawn over a shorter axial length, such that the length of the vertical sidewall portion 14 is shorter in FIG. 2A than in FIG. 1A.

Regarding the inner centre panel tool 60 in FIGS. 2A and 2B, the tool 60 has a substantially flat circular outer axial face 62, having a diameter D3, from which a curved panel radius 64 extends radially outwardly with a radius R2. At the radially outer peripheral edge of the inner centre panel tool 60, extending outwardly from the curved panel radius 64, there is provided a substantially U-shaped recess 65 with a radius of curvature substantially less than the radius R2, and curved in the opposite sense to the panel radius R2 so as to be concave with respect to the axially outer side of the inner centre panel tool 60.

Unlike with the inner centre panel tool 60 of FIGS. 1A and 1B, the inner centre panel tool 60 of FIGS. 2A and 2B has a diameter D4 at its radially outer peripheral edge 66 which substantially corresponds to the diameter of the radially inner wall of inner wall tool 70. Accordingly, as the drawn bowl-shaped inner portion of the can end shell 10 of FIG. 2A is re-formed against the inner centre panel tool 60 of FIG. 2B, by moving the inner centre panel tool 60 of FIG. 2B axially outwardly relative to the inner and outer wall tools 70, 90 and 100, the inner portion of the can end shell 10, and in particular the sidewall portions 12 and 14 of the can end shell 10, are pressed against the panel radius 64 and U-shaped annular groove 65 of the inner centre panel tool 60, causing the sidewall portions 12 and 14 of the can end shell 10 of FIG. 2A to re-form as a substantially flat circular centre panel 1008 having a curved panel wall 64 with an inner surface having a radius of curvature substantially equal to the radius R2 of the peripheral panel wall 64 of the inner centre panel tool 60, and an annular reinforcing bead 1002, substantially conforming to the U-shaped annular grooves 65 at the peripheral edge of the inner centre panel tool 60.

As the bowl-shaped central portion of the can end shell 10 is pressed against the inner centre panel tool 60 of FIG. 2A during the re-forming operation, the concave chuckwall structure 18 also serves to resist the axial compression, forcing the vertical sidewall portion 14 and the curved sidewall portion 12 of the can end shell 10 to conform to the axially outer surface 62, 64, 65 of the inner centre panel tool 60, and furthermore causing the vertical wall portion 14 of the sidewall of the can end shell 10 to buckle radially inwardly so as to form a convex annular bead 1004 between the chuckwall 1018 and the concave annular bead 1002 of the can end 1010. The annular bead 1002 is concave with respect to the outer surface of the can end 1010, whilst the annular bead 1004 is convex with respect to the outer surface of the can end 1010.

The concave annular bead 1002 is also concave with respect to the radially inner direction and the concave annular bead 1004 is convex with respect to the radially inner direction, and so these beads serve to resist the inward tensile forces to which the can end reinforcing structure may be subjected when attached to the axial end of a pressurised carbonated beverage can, due to the internal pressure acting on the inner surface of the centre panel. Accordingly, the concavo-convex annular bead structure in the can end FIG. 2B provides a very strong pressure resistant structure able to withstand high internal pressures, which may permit the thickness or gauge of the sheet material used for forming the can end to be reduced, or may allow a cheaper sheet material or sheet metal alloy to be used whilst still providing the necessary performance characteristics for the can end.

Notably, the radius of curvature R2 of the curved peripheral walls 64 of the centre panel tool 60 is much larger than the radius of curvature R2 at the peripheral edge 64 of the inner centre panel tool 60 of FIGS. 1A and 1B, but is nevertheless still smaller than the radius of curvature R1 of the outer centre panel tool 80. In a similar way, the circular annular axially inner face 82 of the outer centre panel tool 80 of FIG. 2A has a smaller outer diameter D1 than the outer diameter D3 of the circular axially outer face 62 of the inner centre panel tool 60.

As compared with the embodiment of FIGS. 1A and 1B, in which the re-forming of the can end shell 10 is an unsupported free re-forming in the peripheral gap between the inner centre panel tools 60 and the inner wall tool 70, the can end 1010 of FIG. 2B is made by a compressive re-forming of the can end shell 10 of FIG. 2A against the axially outer surface 62, 64, 65 of the inner centre panel tool 60, thus providing a greater degree of dimensional control over the eventual shape of the recessed reinforcing structure.

In the embodiment of FIGS. 2A and 2B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.096, more generally from 0.09 to 0.1, more generally from 0.08 to 0.25, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.86, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the annular bead 1002 has a radius of curvature equal to or approximately equal to 0.5 mm, more generally from 0.45 mm to 0.6 mm, more generally from 0.4 mm to 0.8 mm.

Figure 3A:
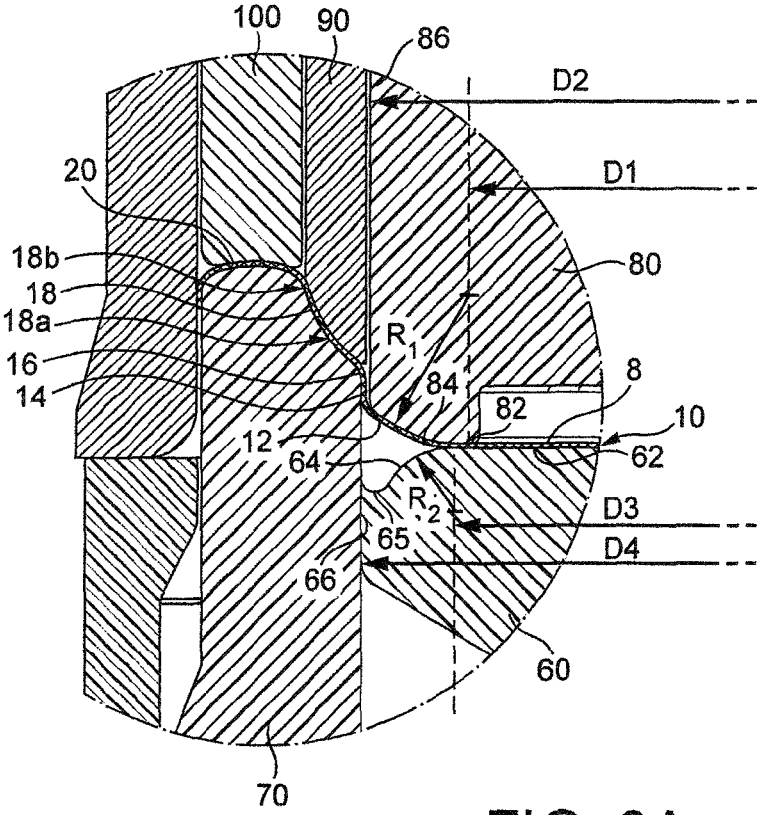
FIG. 3A shows an enlarged view of a peripheral portion of a third embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 3B:
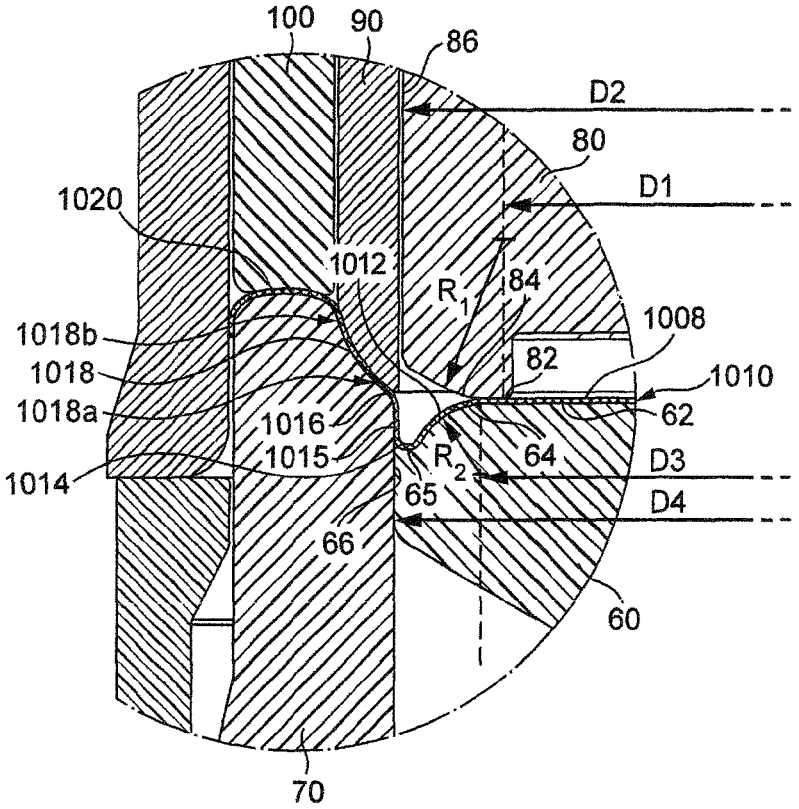
FIG. 3B shows an enlarged view of a peripheral portion of a third embodiment of a can end formed by re-forming the can end shell of FIG. 3A using the inner and outer sets of tools of the can end manufacturing apparatus of FIG. 3A and as also seen in cross-sectional view in a plane which contains the longitudinal axes of the can end and of the opposed inner and outer tooling sets.

Turning to FIGS. 3A and 3B, substantially the same tooling is shown as for FIGS. 2A and 2B. Similarly, the can end shell 10 of FIG. 3A is substantially the same as the can end shell 10 of FIG. 2A. Accordingly, the relevant description given for FIGS. 1A, 1B, 2A and 2B above applies equivalently for FIGS. 3A and 3B.

The main difference between the embodiments of FIGS. 2A and 2B and FIGS. 3A and 3B is the extent to which the can end shell 10 is compressed against the inner centre panel tool 60 during the re-forming operation.

As seen in FIG. 3B, the re-forming operation in this example has been terminated before the vertical sidewall 14 of the can end shell 10 is caused to buckle radially inwards, such that the can end 1010 of FIG. 3B maintains a substantially vertical (i.e., aligned with the central axis of the can end and tooling) outer countersink wall 1015, and a curved countersink base 1014, conforming to the annular groove 65 of the inner centre panel tool 60, is provided in place of the concave annular bead 1002 of FIG. 2B.

Thus, as compared with the example of FIG. 2B, the can end structure of FIG. 3B has an open countersink structure having a substantially straight, axially aligned radially outer countersink wall 1015 and a curved radially inner countersink wall 1012, defined by the curved axially outer surface 64 extending from the circular central portion of the axially outer face 62 of the inner centre panel tool 60, such that the inner and outer countersink walls 1015, 1012 diverge away from one another in the axially outer direction, instead of converging towards one another as in the case of the convex bead 1004 and the curved panel wall 1012 of the can end 1010 of FIG. 2B.

By further comparison, FIG. 1B shows a can end 1010 having a more traditional countersink structure, with sharp bends 1012, 1016 connecting to the centre panel 1008 and chuckwall 1018. These sharp bends were previously considered necessary to provide the structural integrity and overall strength of the can end, in particular in view of the thinning of the blank material in the region of the countersink which traditionally occurs during drawing of the can end shell. By contrast, the method and apparatus of the present invention permits the can end shell 10 to be drawn without substantial thinning of the sidewall portions 12 and 14, such that an alternative countersink structure, such as that shown in FIG. 3B, can be implemented while retaining the necessary pressure performance of the can end.

Furthermore, it will be appreciated that significantly less material is needed in order to form the short vertical outer countersink wall 1015 in FIG. 3B as compared with the amount of material needed to form the complex concavo-convex bead structure, including the beads 1002 and 1004, in the can end 1010 of FIG. 2B. As such, the can end 1010 of FIG. 3B can be made from a reduced diameter blank as compared with the structure of FIG. 2B.

In the embodiment of FIGS. 3A and 3B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.096, more generally from 0.09 to 0.1, more generally from 0.08 to 0.25, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.86, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 4A:
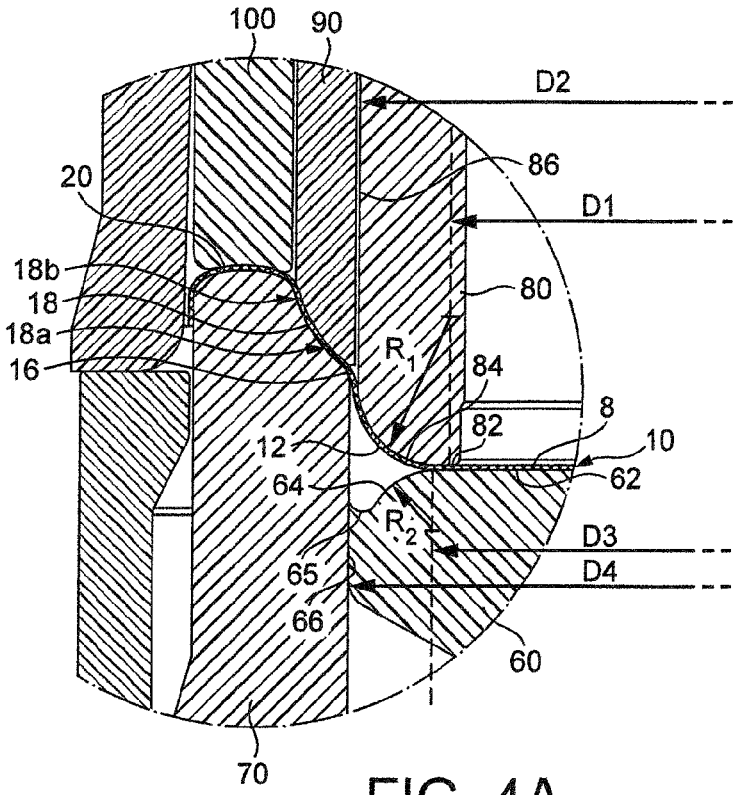
FIG. 4A shows an enlarged view of a peripheral portion of a fourth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 4B:
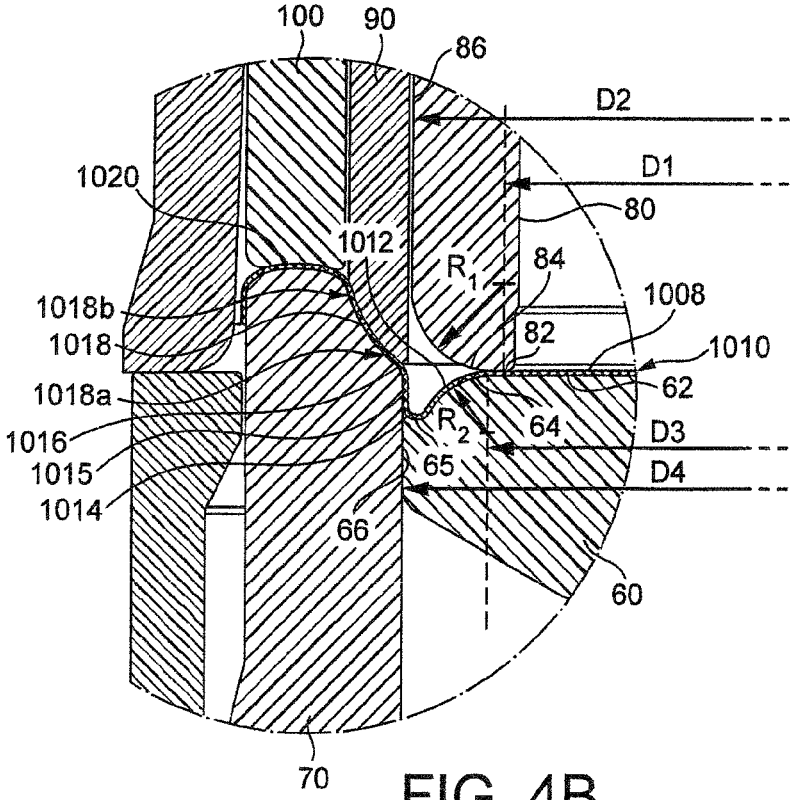
FIG. 4B shows an enlarged view of a peripheral portion of a fourth embodiment of a can end formed by re-forming the can end shell of FIG. 4A using the inner and outer sets of tools of the can end manufacturing apparatus of FIG. 4A and as also seen in cross-sectional view in a plane which contains the longitudinal axes of the can end and of the opposed inner and outer tooling sets.

Turning to FIGS. 4A and 4B, a further embodiment of the present invention is shown. In this case, the inner tool set, including the inner central panel tool 60 and the inner wall tool 70, is substantially the same as in the embodiments of FIGS. 2 and 3. Similarly, the outer wall tools 90 and 100 are substantially the same as in the embodiments of FIGS. 2 and 3. Accordingly, the relevant description given for FIGS. 1A, 1B, 2A, 2B, 3A and 3B above applies equivalently for FIGS. 4A and 4B.

However, in the embodiment of FIGS. 4A and 4B the outer centre panel tool 80 is differently formed, and in particular, the radiused peripheral edge 84 of the outer centre panel tool 80 does not provide a continuation of the curvature of the axially inner face of the outer chuckwall tool 90, but instead has a different radius of curvature R1, which blends tangentially both with the circular axially inner face 82 and the outer peripheral wall 86 of the outer centre panel tool 80. With this arrangement, a less sharp bend 16 is formed in the can end shell 10 when the blank is drawn by the outer centre panel tool 80, and the vertical sidewall section 14 of the bowl-shaped inner central portion of the can end shell 10 of FIGS. 1 to 3 can be eliminated, such that an entirely curved sidewall 12 is provided extending from the bend 16, which joins the sidewall 12 with the curved chuckwall 18, to the substantially circular base 8 of the can end shell 10.

During the subsequent re-forming operation, the initial curvature of the curved sidewall 12 of the can end shell 10 serves to guide the sidewall portion of the can end shell 10 into the recess defined by the peripheral portions 64, 65 of the inner centre panel tool 60 as the can end shell 10 is compressed against the inner centre panel tool 60. Thus, as shown in FIG. 4B, the can end shell sidewall 12 is re-formed around the curved outer peripheral wall 64 of the inner centre panel tool 62 to form a sloping curved panel wall 1012 of the can end 1010. Similarly, the curved material of the sidewall 12 of the can end shell 10 is directed during the compression induced by the re-forming operation so as to conform to the U-shaped annular groove 65 to form a curved base 1014 of the countersink, joined to a substantially vertical (i.e., aligned with the central axis of the can end) wall 1015, serving as a radially outer countersink wall, and joined to the chuckwall 1018 by a convex bend 1016.

The design of the can end 1010 of FIG. 4B is thus geometrically substantially identical to the can end 1010 of FIG. 3B, although the outer centre panel tool 80 of FIG. 4A provides an alternative apparatus and method for forming the can end shell 10 from which the can end 1010 is re-formed.

In the embodiment of FIGS. 4A and 4B, the indicated dimensions are as follows (the ranges including the end values):

R1 is equal to 3.175 mm or approximately equal to 3.2 mm, and more generally may be from 3.1 mm to 3.3 mm, more generally from 3.2 mm to 3.5 mm, more generally from 3.1 mm to 5 mm, more generally from 3 mm to 7 mm.

D1 is equal to 41.275 mm or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.067, more generally from 0.07 to 0.08, more generally from 0.06 to 0.1, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.87, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 5A:
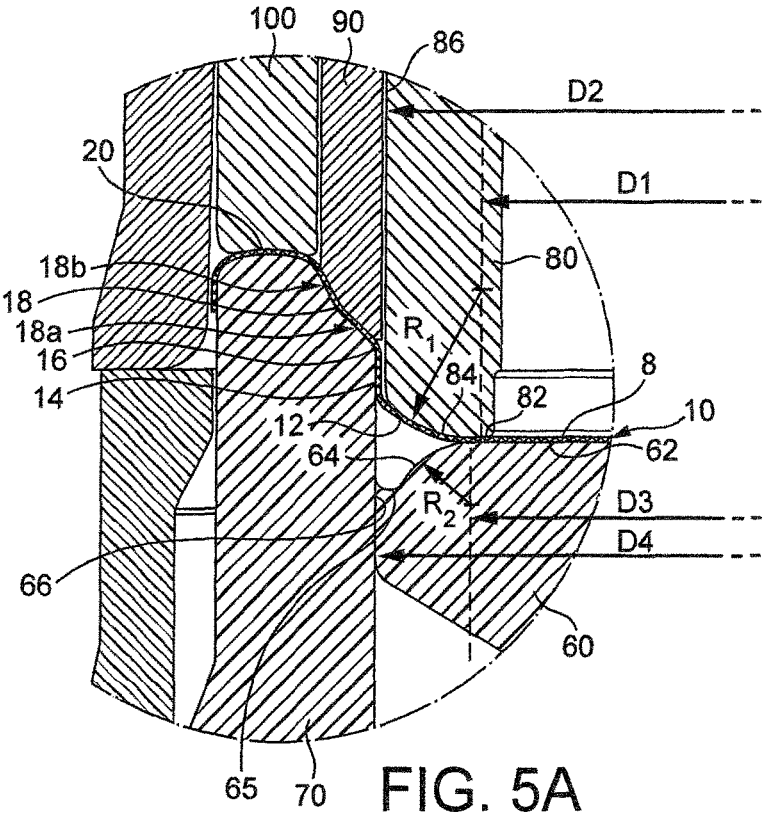
FIG. 5A shows an enlarged view of a peripheral portion of a fifth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 5B:
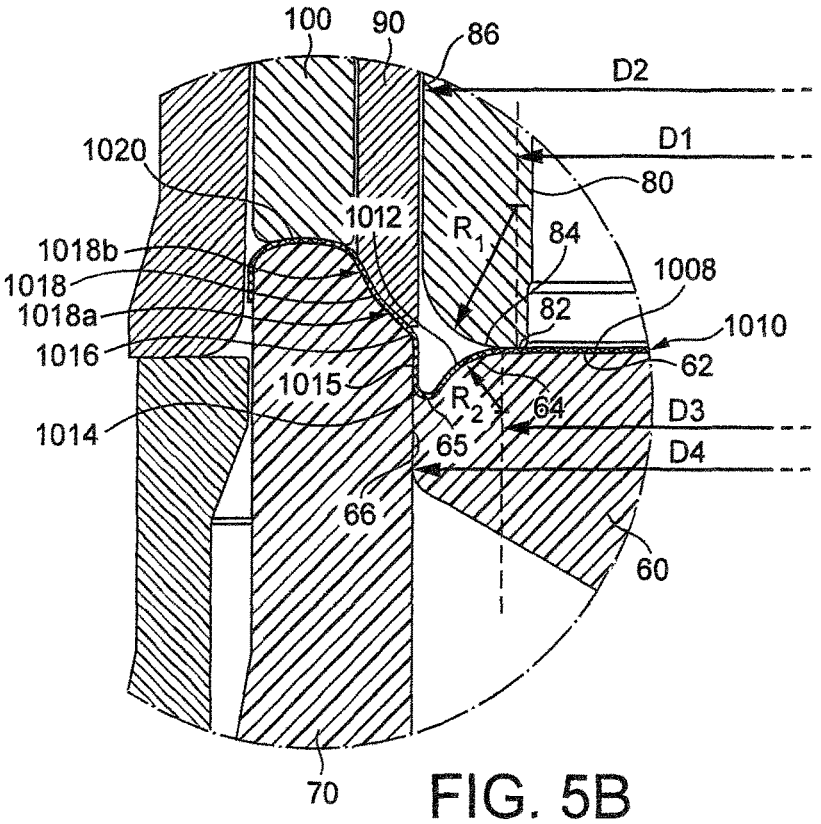
FIG. 5B shows an enlarged view of a peripheral portion of a fifth embodiment of a can end formed by re-forming the can end shell of FIG. 5A using the inner and outer sets of tools of the can end manufacturing apparatus of FIG. 5A and as also seen in cross-sectional view in a plane which contains the longitudinal axes of the can end and of the opposed inner and outer tooling sets.

Referring next to FIGS. 5A and 5B, there is shown an embodiment which corresponds substantially with that of FIGS. 3A and 3B, with the exception of the design of the chuckwall 18, 1018 and the corresponding axially inner and outer end surfaces of the outer chuckwall tool 90 and inner wall tool 70. Accordingly, the relevant description given for FIGS. 1A, 1B, 2A, 2B, 3A, 3B, 4A and 4B above applies equivalently for FIGS. 5A and 5B.

As a result of the variation in the chuckwall design, the axially inner end surface of the outer chuckwall tool 90 does not represent a precise continuation of the curvature provided on the radiused peripheral edge 84 of the outer centre panel tool 80. Instead, the chuckwall 18, 1018 is formed as two substantially straight wall sections, joined by an intermediate bend, so as to provide the above-noted desired concave shape to the chuckwall 18, 1018.

Accordingly, the embodiment of FIGS. 5A and 5B provides the desired concave structure to the chuckwall 18, 1018, which may be beneficial for the re-forming process when the can end shell 10 is compressed against the inner centre panel tool 60 in order to form the can end 1010, in the same way as in the preceding embodiments. However, the structure of the chuckwall 18, 1018, having two straight-walled sections joined by a relatively sharp bend, as opposed to a chuckwall of a continuous larger radius of curvature, may be preferable for some applications in terms of improving or controlling the behaviour of the can end when under pressure during manufacturing and handling, or in terms of obtaining a desired failure mode when the strength of the can end is exceeded.

In the embodiment of FIGS. 5A and 5B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.096, more generally from 0.09 to 0.1, more generally from 0.08 to 0.25, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.86, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 6A:
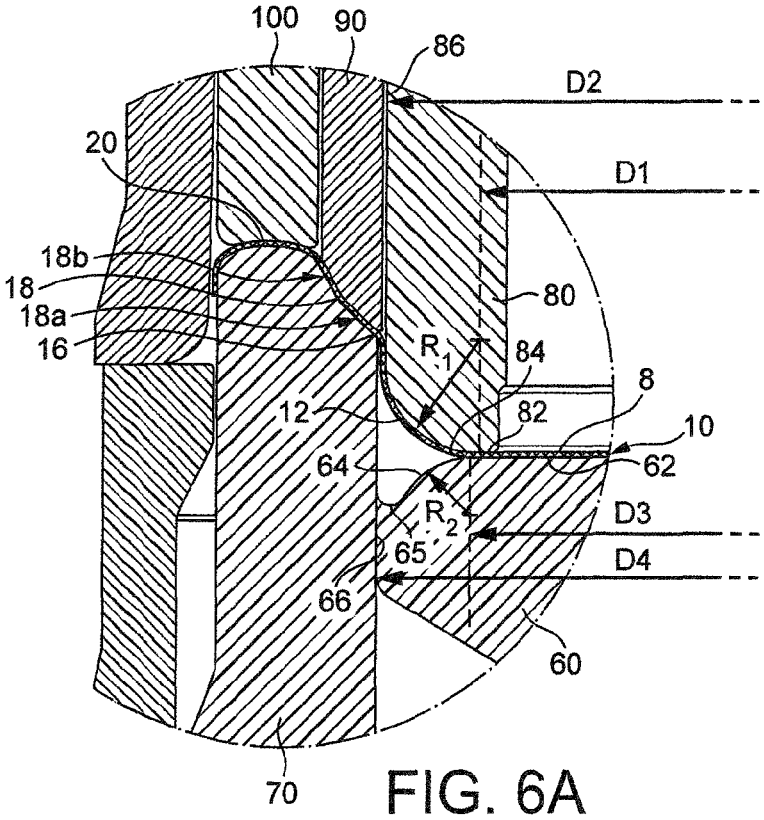
FIG. 6A shows an enlarged view of a peripheral portion of a sixth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 6B:
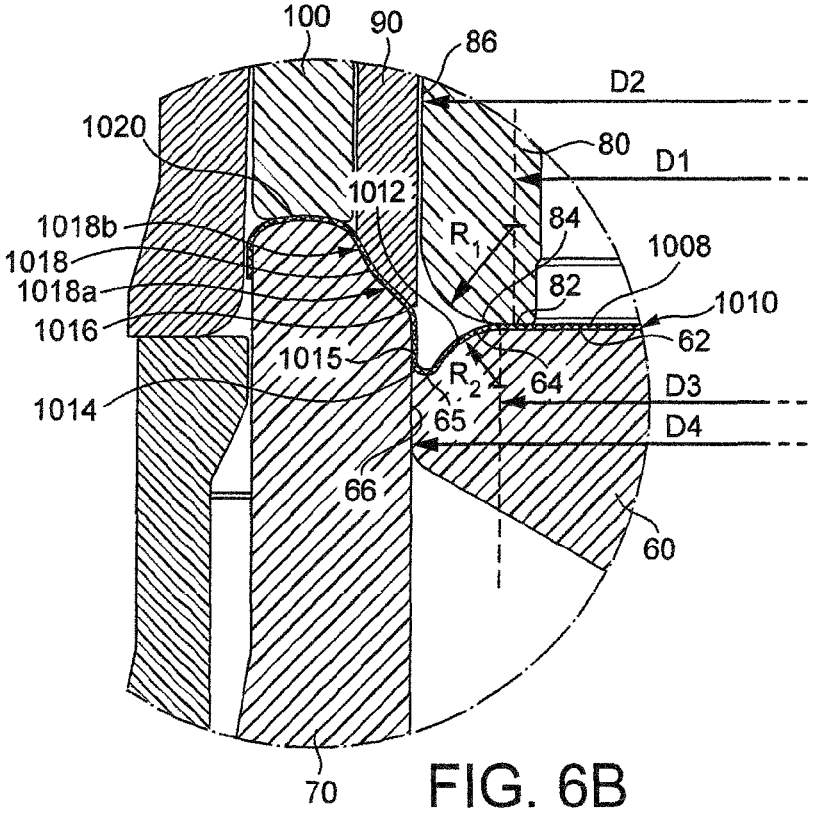
FIG. 6B shows an enlarged view of a peripheral portion of a sixth embodiment of a can end formed by re-forming the can end shell of FIG. 6A using the inner and outer sets of tools of the can end manufacturing apparatus of FIG. 6A and as also seen in cross-sectional view in a plane which contains the longitudinal axes of the can end and of the opposed inner and outer tooling sets.

With reference next to FIGS. 6A and 6B, a further embodiment is shown which most closely resembles the embodiment of FIGS. 4A and 4B, but again having the modified chuckwall structure and corresponding inner and outer axial surfaces of the outer chuckwall tool 90 and inner wall tool 70 as in the embodiment of FIGS. 5A and 5B. Accordingly, the relevant description given for FIGS. 1A, 1B, 2A, 2B, 3A, 3B, 4A, 4B, 5A and 5B above applies equivalently for FIGS. 6A and 6B.

Specifically, the embodiment of FIGS. 6A and 6B has a chuckwall 18, 1018 formed with two substantially straight wall sections joined by a relatively sharp bend, thus providing the desired concave structure to the chuckwall 18, 1018 as may be beneficial for the re-forming process, and which may provide desired properties during manufacturing and handling of a canned carbonated beverage and as regards its failure mode.

Furthermore, in this embodiment, the outer centre panel tool has a radiused peripheral edge 84 which extends tangentially radially outwardly from the substantially flat annular circular end face 82 of the outer centre panel tool 80, and also blends tangentially with the outer peripheral wall 86 of the outer centre panel tool 80, having a constant radius of curvature R1. In this way, the vertical sidewall portion 14 of the can end shell 10 as is present in the embodiments of FIGS. 1A, 2A, 3A and 5A can be eliminated, providing for a continuously curved sidewall 12 of the bowl-shaped central portion of the can end shell 10. For certain designs of can ends, this may beneficially also reduce the thinning of the blank material during drawing of the can end shell 10, or may preferentially control the flow of the blank material during the drawing operation so as to arrive at a distribution of the thickness throughout the can end shell which is optimal for the subsequent re-forming of the can end shell 10 into a can end 1010 as shown in FIG. 6B.

In the embodiment of FIGS. 6A and 6B, the indicated dimensions are as follows (the ranges including the end values):

R1 is equal to 3.175 mm or approximately equal to 3.2 mm, and more generally may be from 3.1 mm to 3.3 mm, more generally from 3.2 mm to 3.5 mm, more generally from 3.1 mm to 5 mm, more generally from 3 mm to 7 mm.

D1 is equal to 41.275 mm or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.067, more generally from 0.07 to 0.08, more generally from 0.06 to 0.1, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.87, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 7A:
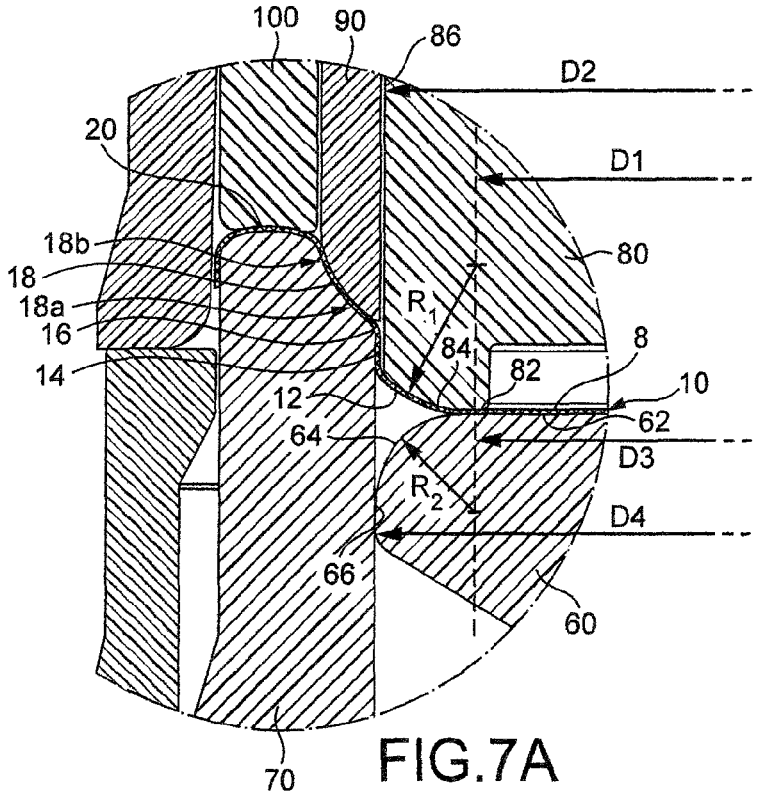
FIG. 7A shows an enlarged view of a peripheral portion of a seventh embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 7B:
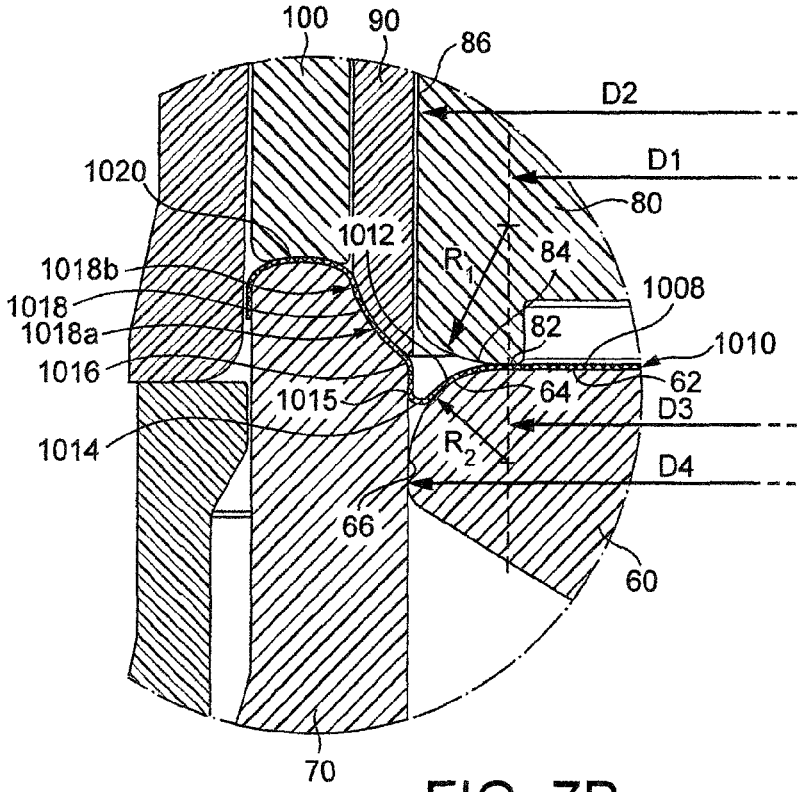
FIG. 7B shows an enlarged view of a peripheral portion of a seventh embodiment of a can end formed by re-forming the can end shell of FIG. 7A using the inner and outer sets of tools of the can end manufacturing apparatus of FIG. 7A and as also seen in cross-sectional view in a plane which contains the longitudinal axes of the can end and of the opposed inner and outer tooling sets.

Turning now to FIGS. 7A and 7B, a further embodiment of the present invention is shown, most similar to the embodiment of FIGS. 3A and 3B, except for the design of the inner centre panel tool 60. Accordingly, the relevant description given for FIGS. 1A, 1B, 2A, 2B, 3A, 3B, 4A, 4B, 5A, 5B, 6A and 6B above applies equivalently for FIGS. 7A and 7B.

In the embodiment of FIGS. 7A and 7B, the inner centre panel tool 60 no longer has the same peripheral structure as the embodiment of FIGS. 2 to 6, but instead provides a radiused annular edge 64 extending between the substantially flat circular axially outer end face 62 and the peripheral radially outer cylindrical sidewall 66 of the inner centre panel tool 60. Specifically, the radiused edge corner 64 extends tangentially radially outwardly from the circular end face 62, and blends tangentially with the cylindrical radially outer wall 66 of the inner centre panel tool 60. In the example shown in FIGS. 7A and 7B, the radiused corner 64 has a constant radius of curvature R2 extending between the circular end face 62 and the outer peripheral wall 66, although it is contemplated that in embodiments of the invention the radius of curvature R2 may vary in an increasing or decreasing fashion extending radially outwardly from the circular centre panel 62.

It will be appreciated that, in this embodiment, the circular end face 62 at the axially outer end of the inner centre panel tool 60 has a diameter D3 which is substantially the same as the diameter D1 of the circular annular axially inner end face 82 of the outer centre panel tool 80. The central portion of the blank can thus reliably be held between the two circular end faces 62 and 82 of the inner centre panel tool 60 and the outer centre panel tool 80 during the drawing of the blank to form the can end shell 10 and the subsequent re-forming of the blank to form the can end 1010. This can be contrasted with the embodiments of FIGS. 1 to 6 as described above, in which the inner centre panel tool 60 has, in each case, a circular axially outer end face 62 with a diameter D3 which is larger than the diameter of the circular axially inner end face 82 of the outer centre panel tool 80, whereby the central portion of the blank or can end shell is nevertheless reliably held between the two centre panel tools 60 and 80.

As will be self-evident, the can end shell 10 formed in FIG. 7A is substantially identical with the can end shell formed in FIG. 3A, as described above.

However, the embodiment of FIGS. 7A and 7B differs from that of FIGS. 3A and 3B regarding the size and position of the radiused outer peripheral edge 64 of the inner centre panel tool 60 and the corresponding shape of the sloping panel wall 1012 of the can end 101, and in that the sidewall portions 12, 14 of the can end shell 10 are only partially constrained during the forming process by which the countersink of the can end 1010 is produced. Specifically, the curved sidewall portion 12 of the can end shell 10 is pressed against the inner centre panel tool 60 so as to conform to the shape of the radiused peripheral edge 64 of the inner centre panel tool 60, whilst the axial compression is resisted by the vertical sidewall portion 14 of the can end shell. However, the curved base 1014 of the countersink of the can end 1010 of FIG. 7B is freely re-formed and not constrained by an annular groove corresponding to the annular groove 65 provided on the inner centre panel tools 60 of FIGS. 2 to 6.

Accordingly, the apparatus for manufacturing a can end of FIGS. 7A and 7B allows slight variations in the design of the can end by altering the degree to which the can end shell is compressed against the inner centre panel tool 60 during the re-forming of the can end shell 10 to form the can end 1010. Perhaps more usefully, this variability permits the manufacturing method of FIGS. 7A and 7B to accommodate variations in the stroke length during the drawing and re-forming steps as may occur from time to time due to changes in environmental conditions or due to tolerances in the manufacture of the tooling sets, such that the can end design can be made reliably and repeatably without producing unusable defective can ends.

In the embodiment of FIGS. 7A and 7B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.096, more generally from 0.09 to 0.1, more generally from 0.08 to 0.25, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.86, more generally from 0.85 to 0.9, more generally from 0.8 to 0.95.

D3/D4 is equal to or approximately equal to 0.87, more generally from 0.85 to 0.9, more generally from 0.8 to 0.95.

Additionally, the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 8A:
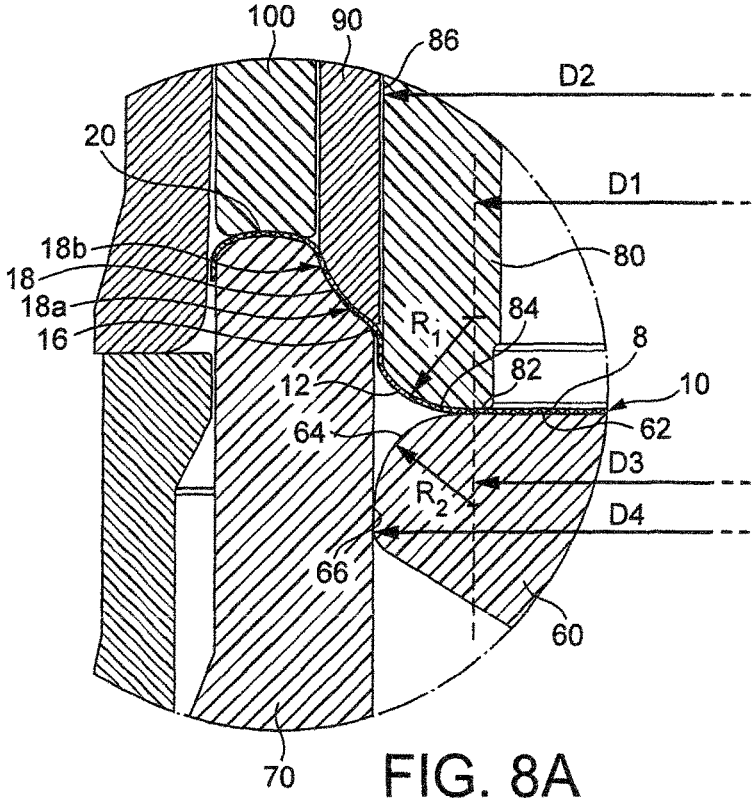
FIG. 8A shows an enlarged view of a peripheral portion of a eighth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 8B:
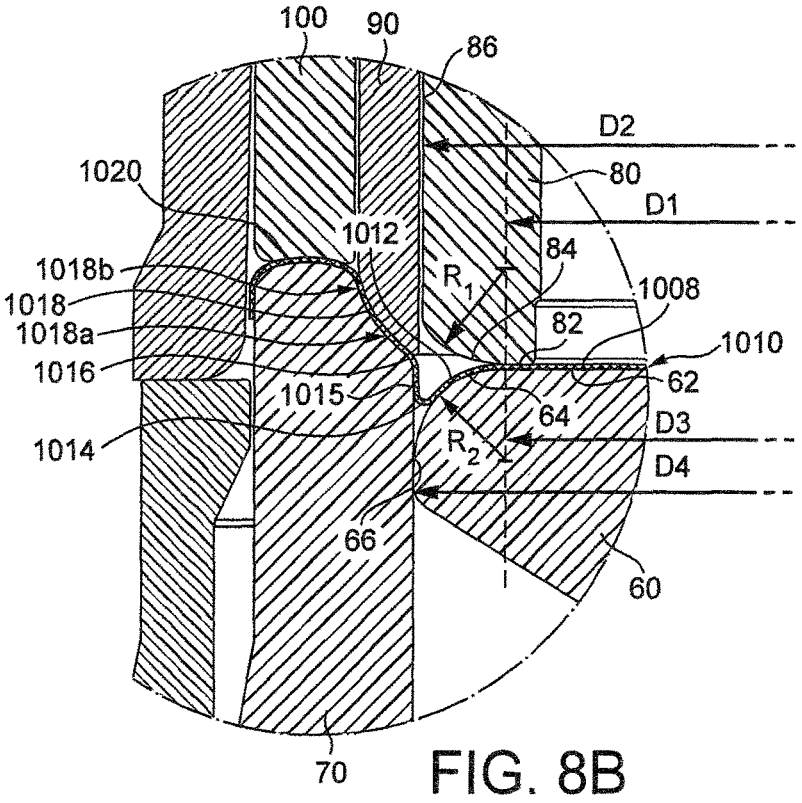
FIG. 8B shows an enlarged view of a peripheral portion of a eighth embodiment of a can end formed by re-forming the can end shell of FIG. 8A using the inner and outer sets of tools of the can end manufacturing apparatus of FIG. 8A and as also seen in cross-sectional view in a plane which contains the longitudinal axes of the can end and of the opposed inner and outer tooling sets.

Turning now to FIGS. 8A and 8B, a further embodiment of the present invention is shown. This embodiment again corresponds most closely with the embodiment of FIGS. 4A and 4B, but having the inner centre panel tool 60 substituted for the inner centre panel tool 60 of FIGS. 7A and 7B. Accordingly, the relevant description given for FIGS. 1A, 1B, 2A, 2B, 3A, 3B, 4A, 4B, 5A, 5B, 6A, 6B, 7A and 7B above applies equivalently for FIGS. 8A and 8B.

In this embodiment, both the inner centre panel tool 60 and the outer centre panel tool 80 have circular axial end faces 62 and 82, respectively, having respective diameters D3 and D1 which are substantially the same. Accordingly, a curved, radiused edge extends radially outwardly from the circular centre panel 82 at the axially inner face of the outer centre panel tool 80, extending tangentially from the circular end face 82 with a constant radius of curvature R1 all the way round to the cylindrical peripheral edge wall 86 of the outer centre panel tool 80, to blend tangentially therewith also. In the same way, a curved radiused annular wall 64 extends radially outwardly from the circular centre panel 62 at the axially outer end face of the inner centre panel tool 60 with a constant radius of curvature R2 and again blends tangentially with the peripheral cylindrical wall 66 at the radial outer side of the inner centre panel tool 60.

In this embodiment, not only are the circular end faces 62 and 82 of the inner centre panel tool 60 and the outer centre panel tool 80 of substantially the same diameter, such that D1 is roughly equal to D3, but also the radii of curvature R1 and R2 of the radiused peripheral edge corners 84 and 64 of the outer centre panel tool 80 and inner centre panel tool 60 are approximately equal.

After forming the can end shell 10 as shown in FIG. 8A, the re-forming process, moving from FIG. 8A to FIG. 8B, proceeds in substantially the same manner as the re-forming process moving from FIG. 7A to FIG. 7B, whereby the central portion of the can end shell 10 is compressed against the inner centre panel tool 60, such that the curved sidewall 12 of the can end shell 10 conforms to the outer surface, in particular the curved peripheral surface 64, of the inner centre panel tool 60. As this compression takes place, the curved shape of the curved sidewall 12 causes the sidewall 12 of the can end shell 10 to buckle radially outwardly, thus forming a substantially vertical outer countersink wall 1015, connected by a curved countersink base 1014 to the panel radius 1012 which forms the radially inner countersink wall. As with the re-forming operation described in relation to FIGS. 7A and 7B, the re-forming of the can end shell moving from FIG. 8A to FIG. 8B allows the curved base of the countersink 1014 to be substantially freely re-formed.

In the embodiment of FIGS. 8A and 8B, the indicated dimensions are as follows (the ranges including the end values):

R1 is equal to 3.175 mm or approximately equal to 3.2 mm, and more generally may be from 3.1 mm to 3.3 mm, more generally from 3.2 mm to 3.5 mm, more generally from 3.1 mm to 5 mm, more generally from 3 mm to 7 mm.

D1 is equal to 41.275 mm or approximately equal to 41 mm, and more generally may be from 40 mm to 42 mm, more generally from 35 mm to 44 mm, more generally from 30 mm to 45 mm.

D2 is equal to 47.625 mm or approximately equal to 47.6 mm, and more generally may be from 47 mm to 48 mm, more generally from 46 mm to 50 mm.

R2 is equal to 3.175 or approximately equal to 3.2 mm, and more generally may be from 3.1 mm to 3.3 mm, more generally from 3.2 mm to 3.5 mm, more generally from 3.1 mm to 5 mm, more generally from 3 mm to 7 mm.

D3 is equal to 41.275 mm or approximately equal to 41 mm, and more generally may be from 40 mm to 42 mm, more generally from 35 mm to 44 mm, more generally from 30 mm to 45 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.067, more generally from 0.07 to 0.08, more generally from 0.06 to 0.1, more generally from 0.05 to 0.5.

R2/D4 is equal to or approximately equal to 0.067, more generally from 0.07 to 0.08, more generally from 0.06 to 0.1, more generally from 0.05 to 0.5.

D1/D2 is equal to or approximately equal to 0.87, more generally from 0.85 to 0.9, more generally from 0.8 to 0.95.

D3/D4 is equal to or approximately equal to 0.86, more generally from 0.85 to 0.9, more generally from 0.8 to 0.95.

Additionally, the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 9A:
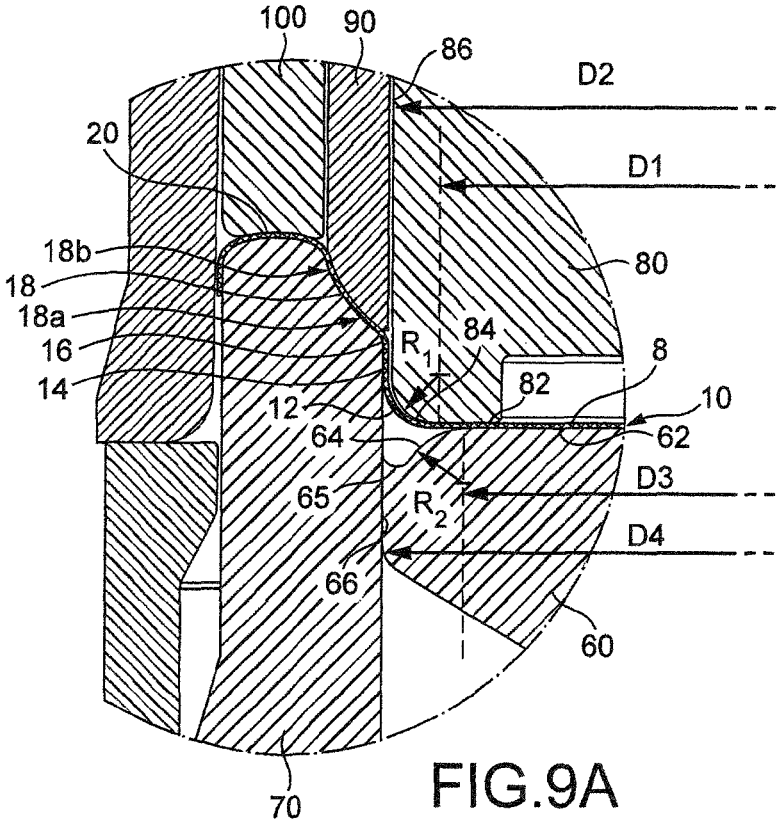
FIG. 9A shows an enlarged view of a peripheral portion of a ninth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 9B:
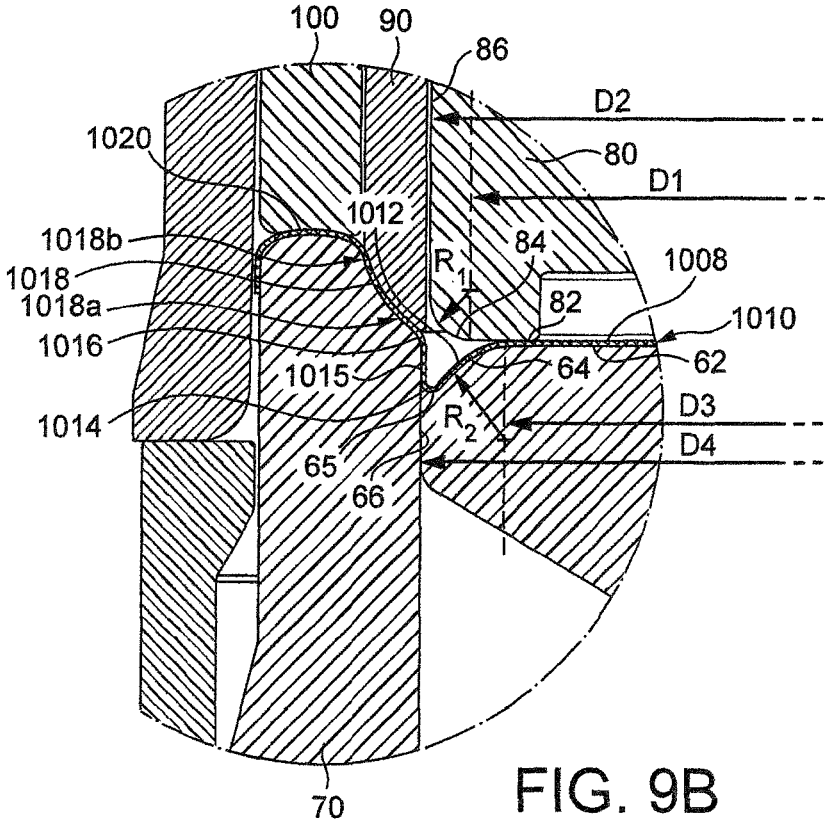
FIG. 9B shows an enlarged view of a peripheral portion of a ninth embodiment of a can end formed by re-forming the can end shell of FIG. 9A using the inner and outer sets of tools of the can end manufacturing apparatus of FIG. 9A and as also seen in cross-sectional view in a plane which contains the longitudinal axes of the can end and of the opposed inner and outer tooling sets.

Moving on to FIGS. 9A and 9B, an embodiment is shown which is substantially equivalent to that shown in FIGS. 4A and 4B. Accordingly, the relevant description given for FIGS. 1A, 1B, 2A, 2B, 3A, 3B, 4A, 4B, 5A, 5B, 6A, 6B, 7A, 7B, 8A and 8B above applies equivalently for FIGS. 9A and 9B.

The main difference between the embodiment of FIGS. 4A and 4B and that of FIGS. 9A and 9B is that the outer centre panel tool 80 has a smaller radius of curvature R1 at the outer peripheral edge corner 84, albeit this still being a larger radius than that which is used in conventional known tools and can end forming apparatuses.

As a result of the smaller radius of curvature R1, the outer centre panel tool 80 is provided with a circular, annular substantially flat end face 82 having a larger outer diameter D1 than in the embodiment of FIGS. 4A and 4B. The annular, circular end face 82 is also made wider, to cover a larger internal radial extent, than the end face 82 in FIGS. 4A and 4B, so as to provide an opposing surface against which the axially outer circular end face 62 of the inner centre panel tool 60 can press, in order to hold the central portion of the blank or can end shell between the inner and outer centre panel tools 60 and 80 during drawing and re-forming operations.

The embodiment of FIGS. 9A and 9B demonstrates that it is not necessary for the diameter of the circular end face 82 of the outer centre panel tool 80 to have a smaller diameter D1 than the diameter D3 of the circular end face 62 of the inner centre panel tool 60, although this is in general preferred, as shown in the embodiments of FIGS. 1 to 6.

In the embodiment of FIGS. 9A and 9B, the indicated dimensions are as follows (the ranges including the end values):

R1 is equal to 1.778 mm or approximately equal to 1.8 mm, and more generally may be from 1.75 mm to 2.0 mm, more generally from 1.7 mm to 2.5 mm, more generally from 1.65 mm to 3 mm.

D1 is equal to 44.07 mm or approximately equal to 44 mm, and more generally may be from 40 mm to 45 mm, more generally from 35 mm to 46 mm, more generally from 30 mm to 47 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.85 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.037, more generally from 0.035 to 0.04, more generally from 0.03 to 0.1, more generally from 0.025 to 0.3.

R2/D4 is equal to or approximately equal to 0.053, more generally from 0.05 to 0.06, more generally from 0.04 to 0.08.

D1/D2 is equal to or approximately equal to 0.925, more generally from 0.90 to 0.93, more generally from 0.85 to 0.95.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 10A:
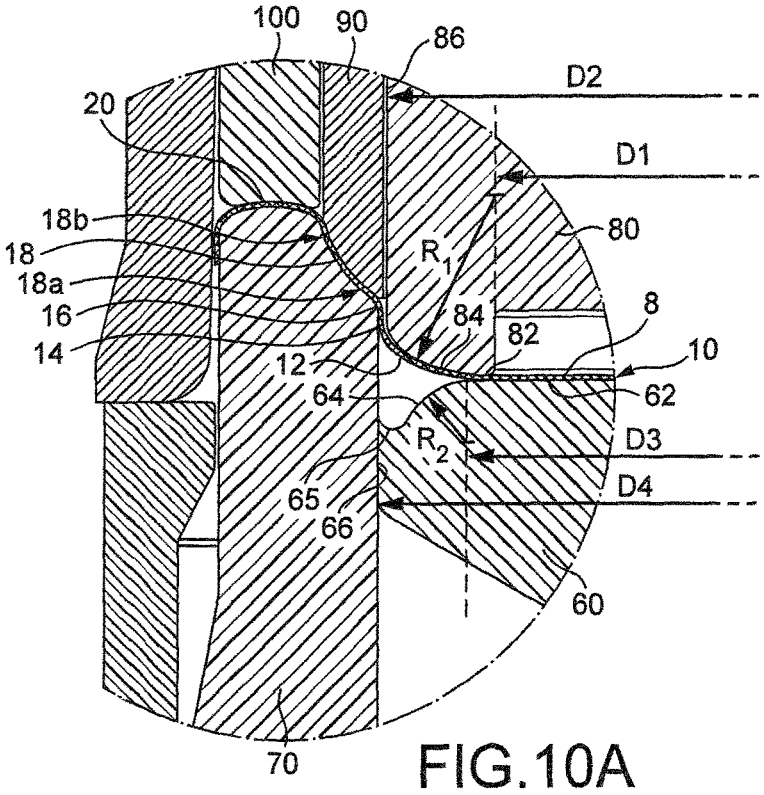
FIG. 10A shows an enlarged view of a peripheral portion of a tenth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 10B:
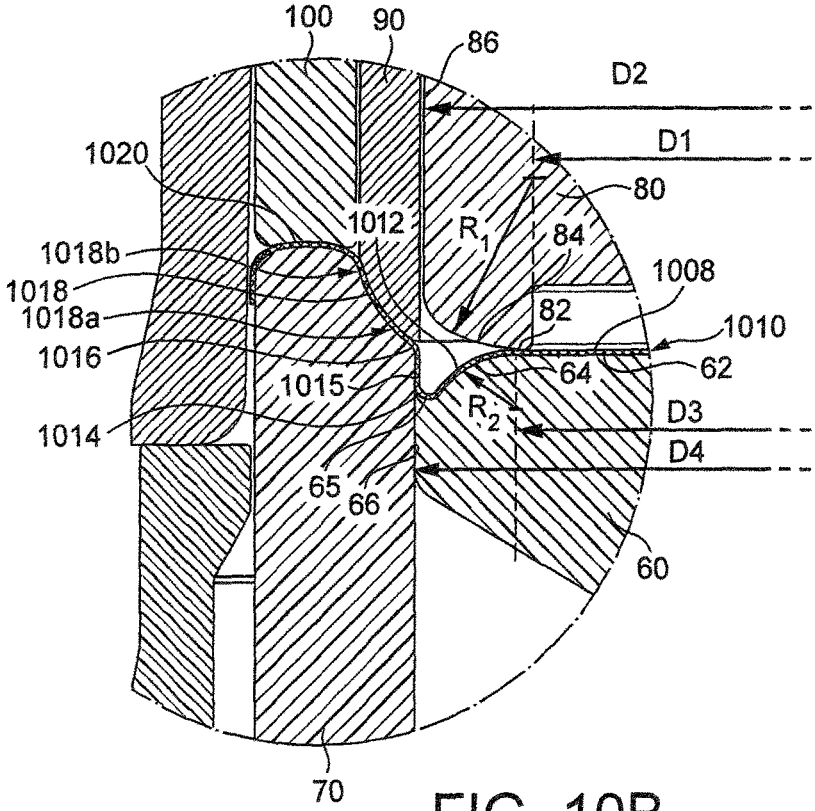
FIG. 10B shows an enlarged view of a peripheral portion of a tenth embodiment of a can end formed by re-forming the can end shell of FIG. 10A using the inner and outer sets of tools of the can end manufacturing apparatus of FIG. 10A and as also seen in cross-sectional view in a plane which contains the longitudinal axes of the can end and of the opposed inner and outer tooling sets.

With reference now to FIGS. 10A and 10B, an embodiment is shown which is substantially equivalent to that shown in FIGS. 3A and 3B, but in which the radius of curvature R1 has been increased. Accordingly, the relevant description given for FIGS. 1A, 1B, 2A, 2B, 3A, 3B, 4A, 4B, 5A, 5B, 6A, 6B, 7A, 7B, 8A, 8B, 9A and 9B above applies equivalently for FIGS. 10A and 10B.

Increasing the radius of curvature in the embodiment of FIGS. 3A and 3B, as shown in FIGS. 10A and 10B, has a substantially opposite effect to that described above for the embodiment of FIGS. 9A and 9B, which is to reduce (rather than increase) the outer diameter D1 of the circular end face 82 of the outer centre panel tool 80, such that the outermost point of contact between the circular annular end face 82 of the outer centre panel tool 80 and the circular end face 62 of the inner centre panel tool 60 is brought radially inwardly.

In the embodiment of FIGS. 10A and 10B, the change in the radius of curvature R1 also has an effect on the structure of the chuckwall 18, 1018, since in this example the axially inner surface of the outer chuckwall tool 90 is maintained as a continuation of the enlarged-radius curvature extending radially outwardly from the curved peripheral edge surface 84 of the outer centre panel tool 80.

As discussed above, the radius of curvature R1 can, in principle, be further enlarged so that the entire axially inner end face of the outer centre panel tool 80 is domed with a radius of curvature R1, i.e., the diameter D1 is reduced to 0.

In the embodiment of FIGS. 10A and 10B, the indicated dimensions are as follows (the ranges including the end values):

R1 is equal to or approximately equal to 6 mm, and more generally may be from 5 mm to 8 mm, more generally from 4 mm to 10 mm, more generally from 3 mm to 15 mm.

D1 is equal to or approximately equal to 40 mm, and more generally may be from 35 mm to 41 mm, more generally from 25 mm to 42 mm, more generally from 10 mm to 43 mm.

D2 is equal to 47.625 mm or approximately equal to 47.6 mm, and more generally may be from 47 mm to 48 mm, more generally from 46 mm to 50 mm.

R2 is equal to or approximately equal to 2.54 mm, more generally from 2.5 mm to 2.6 mm, more generally from 2 mm to 4 mm.

D3 is equal to or approximately equal to 41.86 mm, more generally from 41 mm to 42 mm, more generally from 40.0 mm to 45 mm, more generally from 35 mm to 50 mm.

D4 is equal to or approximately equal to 48.15 mm, more generally from 48 mm to 49 mm, more generally from 45 mm to 50 mm, more generally from 40 mm to 55 mm.

R1/D2 is equal to or approximately equal to 0.125, more generally from 0.12 to 0.15, more generally from 0.1 to 0.25, more generally from 0.05 to 0.5.

R2/D4 is equal to or approximately equal to 0.053, more generally from 0.05 to 0.06, more generally from 0.04 to 0.08.

D1/D2 is equal to or approximately equal to 0.84, more generally from 0.75 to 0.85, more generally from 0.5 to 0.9.

D3/D4 is equal to or approximately equal to 0.87, more generally from 0.85 to 0.9, more generally from 0.8 to 0.95.

Additionally, the peripheral U-shaped recess 65, which defines (i.e., is substantially equal to) the radius of curvature on the inner surface of the curved base 1014 of the countersink, has a radius of curvature equal to or approximately equal to 0.5 mm, more generally from 0.45 mm to 0.6 mm, more generally from 0.4 mm to 0.8 mm.

Turning to FIGS. 11A and 11B, there is shown an embodiment of a can end shell 10 and a can end 1010 re-formed from it in accordance with a method and apparatus as described herein.

With regard to FIG. 11A, the can end shell 10 includes an outer peripheral seam 20, with a chuck wall 18 extending radially and axially inwardly therefrom. The chuck wall 18 has a radially outer end 18*b* and a radially inner end 18*a*. The chuck wall 18 includes two substantially straight wall portions joined by an intermediate bend which is concave with respect to the outer surface of the can end shell 10. The radially inner end 18*a* of the chuck wall 18 is connected to a substantially-straight near-vertical sidewall 14 of the can end shell by a bend 16 which is convex with respect to the outer surface of the can end shell 10.

Straight wall portion 14 forms a first part of the sidewall of the can end shell 10. A second part of the sidewall of the can end shell 10 is a curved sidewall 12, concave with respect to the outer surface of the can end shell, extending axially and radially inwardly from the straight wall portion 14, and connecting at its other end to the circular base or end panel 8 of the can end shell 10. In this example, the curved sidewall portion 12 extends radially outwardly from the circular base 8 of the can end shell 10 with a radius of curvature R1 which is substantially continuous through the curved sidewall portion 12 except in the vicinity of the straight wall portion 14, where the radius of curvature is locally reduced.

As regards the near-vertical sidewall portion 14, this is, as shown, inclined that an angle θ to the axis of rotation of the can end shell 10. The angle θ may be as large as 15°, but is preferably in the range of 3 to 10°, and may be from 5 to 7°.

As regards the chuck wall 18, the straight-walled portion of the chuck wall extending to the outer end 18*b* of the chuck wall extends at an angle β to the axis of rotation, whereas the straight-walled portion extending to the inner and 18*a* of the chuck wall extends at an angle α to the axis of rotation. The angle α is greater than the angle β.

Referring next to FIG. 11B, the re-formed can end 1010 is shown, having an outer peripheral seam 1020 and chuck wall 1018 which are substantially unchanged as compared with the peripheral seam 20 and chuck wall 18 of the can end shell 10. That is to say, the straight wall extending to the outer end 1018*b* extends substantially at the same angle β relative to the axis of rotation as the straight wall extending to the outer end 18*b* of the chuck wall 18 of the can end shell 10, and the straight wall extending to the inner end 1018*a* of the chuck wall 1018 of the can end 1010 extends at substantially the same angle α relative to the axis of rotation as the straight wall extending to the inner end 18*a* of the chuck wall 18 of the can end shell 10.

The re-formed can end 1010 has an outer countersink wall 1015 which is substantially vertical, similarly to the straight sidewall portion 14 of the can end shell 10. Radially outer countersink wall 1015 of the can end 1010 is substantially straight and extends relative to the axis of rotation of the can end at an angle ϕ which may be the same as the angle θ of the straight wall portion 14 of the can end shell 10, or maybe larger or smaller than this angle, for example by +/−5°, preferably +/−3°, more preferably +/−1°.

The can end 1010 has a curved countersink base 1014 which, in this example, has a substantially continuous single radius of curvature extending between the outer countersink wall 1015 and an inner countersink wall 1013. The inner countersink wall 1013 is connected to the centre panel 1008 by a sloping peripheral panel wall 1012, whose shape is defined by the inner centre panel tool against which the can end shell 10 was re-formed. In the embodiment of FIG. 11B, the sloping panel wall 1012 does not have a constant radius of curvature, but exhibits a straight wall portion extending between the radially inner countersink wall 1013 and the centre panel 1008 and connected to each via respective bends having small radii of curvature. The sloping panel wall may extend at an angle to the axis of rotation of the can end of from 30 to 60 degrees, and may be substantially equal to 45 degrees.

By drawing the can end shell 10 in accordance with the method and apparatus of the present invention, and then re-forming the can end shell 10 to form the can end 1010, excessive thinning of the blank material can be avoided in the region of the countersink formed of the radially inner and outer countersink walls 1013, 1015 and the curved countersink base 1014, as well as in the connecting regions of the convex bend 1016 and the sloping panel wall 1012. As such, the can end 1010 can exhibit improved strength, pressure performance, and failure behaviour as compared to a similar can end made by conventional or known methods and apparatus. Furthermore the can end may be designed to incorporate features and geometry that are not possible using methods and apparatus of the prior art. For example, the method may enable a radius of curvature on the inner surface of the curved base 1014 of the countersink that is smaller than envisaged in the examples described herein.

In the embodiment of FIGS. 11A and 11B, the indicated dimensions are as follows (the ranges including the end values):

R1 is equal to or approximately equal to 4.57 mm, and more generally may be from 4.5 mm to 4.6 mm, more generally from 4.3 mm to 4.8 mm, more generally from 4 mm to 5 mm, more generally from 3 mm to 7 mm.

D1 is equal to or approximately equal to 41 mm, and more generally may be from 40 mm to 42 mm, more generally from 35 mm to 44 mm, more generally from 30 mm to 45 mm.

D3 is equal to or approximately equal to 41.86 mm, more generally from 41 mm to 42 mm, more generally from 40.0 mm to 45 mm, more generally from 35 mm to 50 mm.

Additionally, the inner surface of the curved base 1014 of the countersink, has a radius of curvature equal to or approximately equal to 0.5 mm, more generally from 0.45 mm to 0.6 mm, more generally from 0.4 mm to 0.8 mm.

Figure 12A:
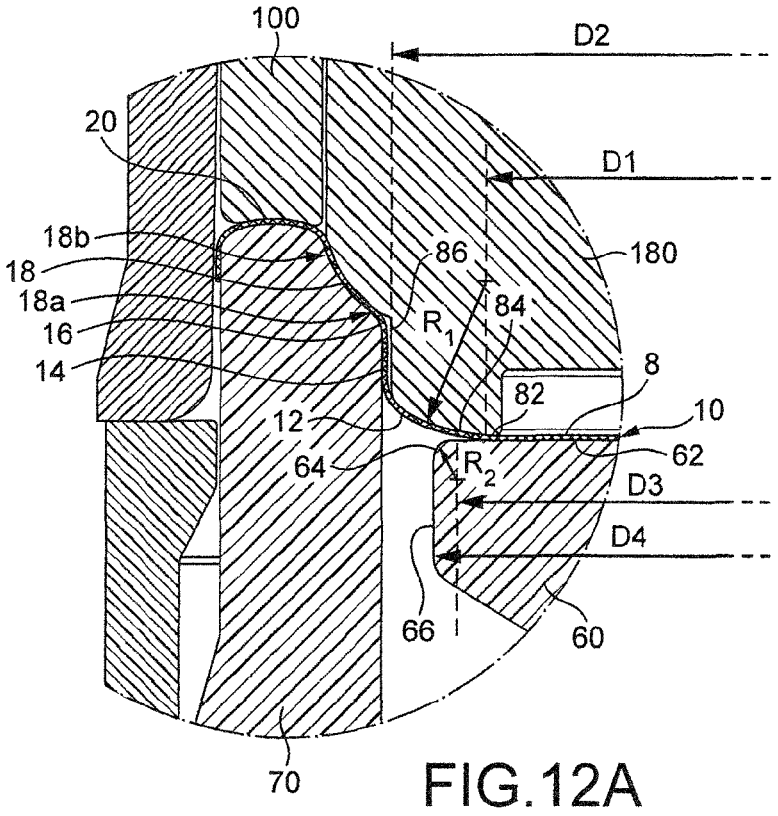
FIG. 12A shows an enlarged view of a peripheral portion of a twelfth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 12B:
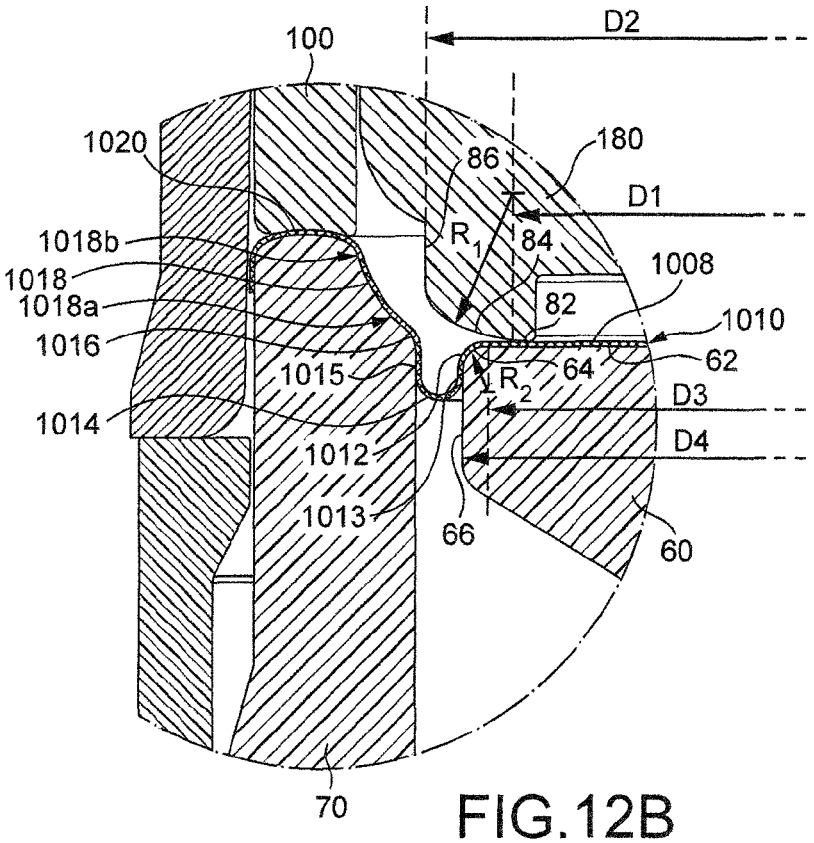
FIG. 12B shows an enlarged view of a peripheral portion of a twelfth embodiment of a can end formed by re-forming the can end shell of FIG. 12A using the inner and outer sets of tools of the can end manufacturing apparatus of FIG. 12A and as also seen in cross-sectional view in a plane which contains the longitudinal axes of the can end and of the opposed inner and outer tooling sets.

Referring now to FIGS. 12A and 12B, there is shown twelfth embodiment of the invention. This embodiment is most similar to that shown in FIGS. 1A and 1B, except that the outer centre panel tool 80 and outer chuckwall tool 90 have been combined into a single outer panel and chuckwall tool 180. Accordingly, the relevant description given for FIGS. 1A, 1B, 2A, 2B, 3A, 3B, 4A, 4B, 5A, 5B, 6A, 6B, 7A, 7B, 8A, 8B, 9A, 9B, 10A and 10B above applies equivalently for FIGS. 12A and 12B.

FIG. 12A shows a can end shell 10 which has been drawn from a circular blank of sheet material between inner and outer tool sets. As described above, the inner tool set includes an inner centre panel tool 60, and an inner wall tool 70 disposed concentrically radially outside the inner centre panel tool 60. Inner centre panel tool 60 has a substantially flat circular axially outer surface 62, joined to the radially outer wall 66 by an annular radiused corner 64 having a radius of curvature R2. A predefined gap exists between the radially outer peripheral wall 66 of the inner centre panel tool 60, having a diameter D4, and the radially inner wall of the inner wall tool 70, into which gap the can end shell 10 can be re-formed so as to define a countersink of the can end 1010. As there is no corresponding forming surface of the inner centre panel tool 60 in this region, the countersink is freely re-formed in the peripheral annular gap between the inner centre panel tool 60 and the inner wall tool 70.

The outer tool set includes a combined outer panel and chuckwall tool 180, and an outer seam tool 100 concentrically surrounding the outer panel and chuckwall tool 180. The outer panel and chuckwall tool has a central structure at its axially inner end which is substantially the same as the outer centre panel tool 80 of FIGS. 1A and 1B. Specifically, this central structure of the combined outer panel and chuckwall tool 180 opposes the inner centre panel tool 60, and has a substantially flat axially inner surface 82 formed as a circular annulus, which operably comes into contact with the axially outer surface 62 of the inner centre panel tool 60 for holding the central portion of a blank or a can end shell between the inner centre panel tool 60 and the outer panel and chuckwall tool 80. This part of the outer panel and chuckwall tool 180 also has a curved wall 84 extending radially and axially outwardly from the circular annular axially inner face 82 with a radius of curvature R1. In the Example of FIG. 12A, the curved annular wall 84 has a constant radius of curvature R1, extending to the outer peripheral wall 86 of the centre structure of the outer panel and chuckwall tool 180. As can be appreciated from FIG. 12A, the radius of curvature R1 of the curved annular wall 84 is significantly larger than the radius of curvature R2 at the peripheral edge 64 of the axially outer end 62 of the inner centre panel tool 60.

As can be seen in FIG. 12A, the radially outer peripheral wall 86 of the centre structure of the outer panel and chuckwall tool 180 has a smaller diameter D2 than the inner peripheral wall of the inner wall tool 70, thus permitting the centre structure of the outer panel and chuckwall tool 180 to slide axially within the upper part of inner wall tool 70. The curved outer edge 84 of the outer centre panel tool extends from the substantially flat annular surface 82 initially tangentially, such that the centre of curvature of the radius R1 lies on a line parallel to the axis of rotation of the can end shell 10 corresponding to the diameter D1, as also shown in FIG. 12A.

The outer panel and chuckwall tool also includes a peripheral structure which substantially replicates the outer chuckwall tool 90. This peripheral structure and the outer seam tool 100 oppose the inner wall tool 70. The inner wall tool 70 has an axially outer surface which cooperates with the axially inner surfaces of the peripheral structure of the outer panel and chuckwall tool 18 and the outer seam tool 100. The inner axial surface of the outer seam tool 100 cooperates with the outer axial surface of the inner wall 70 to define a seam 20 of the can end shell 10. Similarly, concentrically radially inside the outer seam tool 100, the peripheral portion of the outer panel and chuckwall tool 180 has an inner axial surface which cooperates with the axially outer surface of the inner wall tool 70 to define a chuckwall 18 of the can end shell 10.

In this embodiment, the chuckwall is curved between its axially inner end 18*a* and its axially outer end 18*b* with a substantially constant radius of curvature.

Moving from FIG. 12A to FIG. 12B, it can be seen that the inner centre panel tool 60 is moved axially outwardly relative to the inner wall tool 70 and the outer seam tool 100, so as to re-form the bowl-shaped inner portion of the can end shell 10 to define a can end 1010 in substantially the same manner as described for FIGS. 1A and 1B above. The main difference here is that the outer panel and chuckwall tool 180 does not remain in contact with the chuckwall 18 during re-forming of the can end shell 10, so that the chuckwall 18 has to withstand the associated axial compressive forces unsupported. As such, some deformation of the chuckwall 18 may occur in the re-forming process of FIGS. 12A and 12B, as compared with FIGS. 1 to 11 and 13. Preferably, the outer panel and chuckwall tool 180 is moved together with the inner centre panel tool 60 during the re-forming process, so as to hold the central portion of the can end shell compressively between the circular axial end faces 62 and 82 during re-forming of the sidewall portions 12, 14.

It will be appreciated that, in the same way as for the embodiment of FIGS. 1A and 1B, the inner centre panel tool 60 of FIG. 1B provides no structure between its radially outer peripheral edge 66 and the radially inner peripheral wall of the inner wall tool 70, such that the countersink is freely formed in the peripheral gap between the inner wall tool 70 and the inner centre panel tool 60. The curved base 1014 of the countersink will thus be substantially continuously curved between the radially inner countersink wall 1013 and the radially outer countersink wall 1015. However, the shape of the curved base 1014 of the countersink may instead be controlled by providing an appropriate forming structure on the outer periphery of the inner centre panel tool 60, or by providing a separate, concentric tool between the inner centre panel tool 60 and inner wall tool 70, if desired. Indeed, any of the inner tooling sets of FIGS. 1 to 10 could be used in conjunction with the outer tooling set of FIGS. 12A and 12B.

Figure 13A:
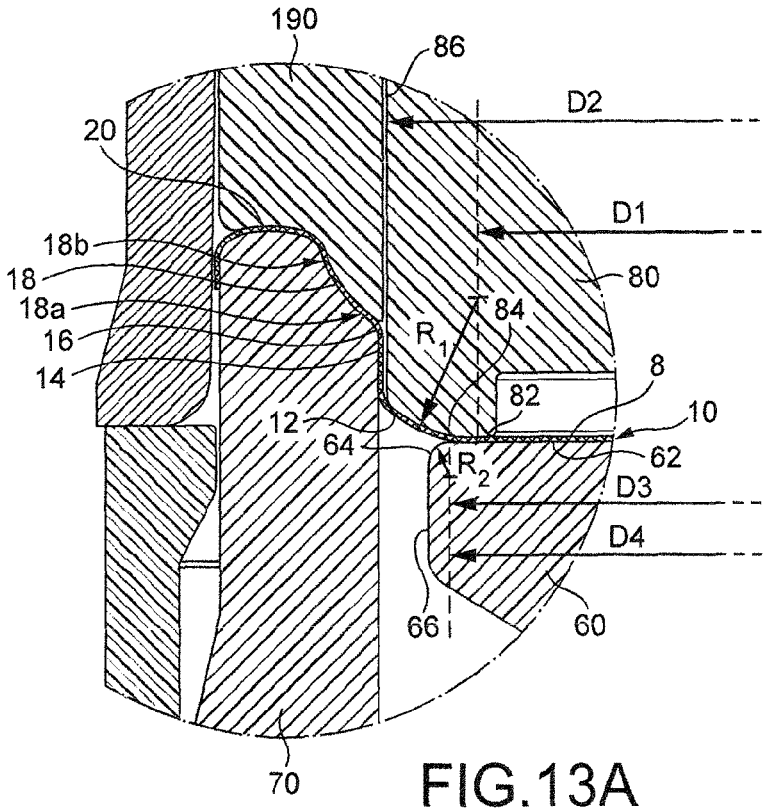
FIG. 13A shows an enlarged view of a peripheral portion of a thirteenth embodiment of a can end shell formed by drawing a circular sheet metal blank between opposed inner and outer sets of tools in a can end manufacturing apparatus as seen in cross-sectional view in a plane which contains the longitudinal axes of the can end shell and of the opposed inner and outer tooling sets.
Figure 13B:
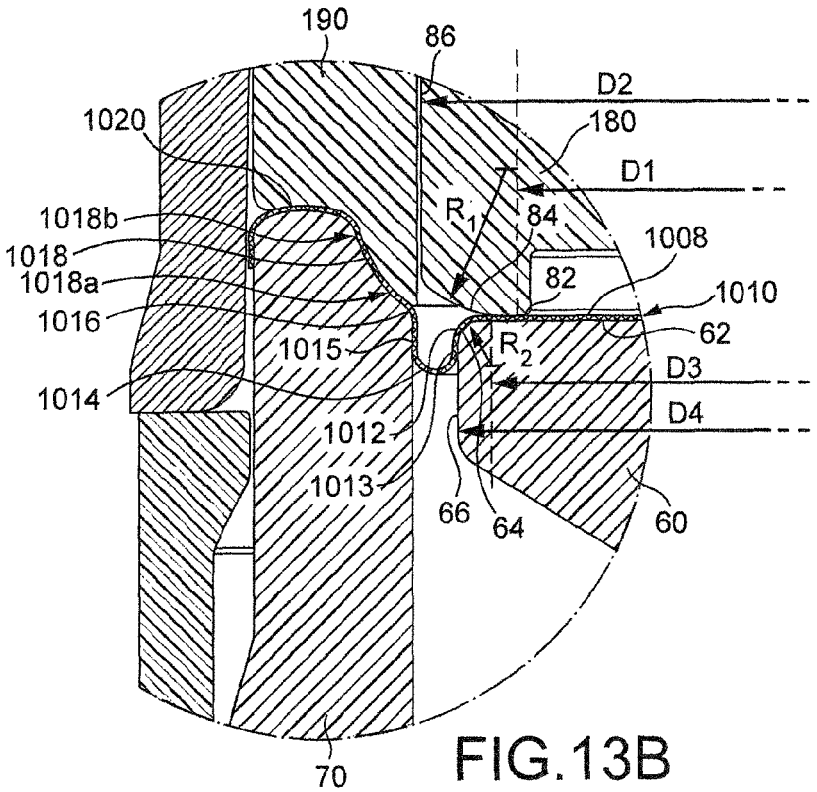
FIG. 13B shows an enlarged view of a peripheral portion of a thirteenth embodiment of a can end formed by re-forming the can end shell of FIG. 13A using the inner and outer sets of tools of the can end manufacturing apparatus of FIG. 13A and as also seen in cross-sectional view in a plane which contains the longitudinal axes of the can end and of the opposed inner and outer tooling sets.

In the embodiment of FIGS. 13A and 13B, the indicated dimensions and ratios are the same as noted in relation to the embodiment of FIGS. 1A and 1B above.

Turning, lastly, to FIGS. 13A and 13B, there is shown thirteenth embodiment of the invention. This embodiment is again most similar to that shown in FIGS. 1A and 1B, except that the outer chuckwall tool 90 and outer seam tool 100 have been combined into a single outer wall tool 190. Accordingly, the relevant description given for FIGS. 1A, 1B, 2A, 2B, 3A, 3B, 4A, 4B, 5A, 5B, 6A, 6B, 7A, 7B, 8A, 8B, 9A, 9B, 10A, 10B, 12A and 12B above applies equivalently for FIGS. 12A and 12B.

FIG. 13A shows a can end shell 10 which has been drawn from a circular blank of sheet material between inner and outer tool sets. As described above, the inner tool set includes an inner centre panel tool 60, and an inner wall tool 70 disposed concentrically radially outside the inner centre panel tool 60. Inner centre panel tool 60 has a substantially flat circular axially outer surface 62, joined to the radially outer wall 66 by an annular radiused corner 64 having a radius of curvature R2. A predefined gap exists between the radially outer peripheral wall 66 of the inner centre panel tool 60, having a diameter D4, and the radially inner wall of the inner wall tool 70, into which gap the can end shell 10 can be re-formed so as to define a countersink of the can end 1010. As there is no corresponding forming surface of the inner centre panel tool 60 in this region, the countersink is freely re-formed in the peripheral annular gap between the inner centre panel tool 60 and the inner wall tool 70.

The outer tool set includes an outer centre panel tool 80, and an outer wall tool 190 which combines the outer chuckwall tool 90 and the outer seam tool 100 in a single tool. The outer centre panel tool 80 is as described in relation to FIGS. 1A and 1B.

The outer wall tool 190 opposes the inner wall tool 70. The inner wall tool 70 has an axially outer surface which cooperates with the axially inner surface of the outer wall tool 190. These opposed axial end faces cooperates to define the seam 20 and the chuckwall 18 of the can end shell 10, in like manner as for the inner wall tool 70, outer seam tool 100 and outer chuckwall tool 90 in the embodiment of FIGS. 1A and 1B.

Moving from FIG. 13A to FIG. 13B, it can be seen that the inner centre panel tool 60 is moved axially outwardly relative to the inner and outer wall tools 70, 190, so as to re-form the bowl-shaped inner portion of the can end shell 10 to define a can end 1010 having an outer peripheral seam 1020, a chuckwall 1018 extending axially and radially inwardly from the seam 1020, a centre panel 1008, and a countersink extending between the chuckwall 1018 and the centre panel 1008. The countersink has a radially inner countersink wall 1013 and a radially outer countersink wall 1015 connected to each other by a curved countersink base 1014. The radially inner countersink wall 1013 is connected to the centre panel 1008 by a panel radius 1012, having a radius of curvature at its inner surface substantially equal to the radius R2 at the peripheral edge 64 of the inner centre panel tool 60. The radially outer countersink wall 15 is connected to the curved chuckwall 1018 by a bend 1016. Whereas the curvature of the countersink wall 1018 is concave with respect to the outer side of the can end 1010, the bend 1016 has a curvature which is convex with respect to the outer side of the can end 1010. Notably, the inner portion of the outer wall tool 190 supports the chuckwall 18 to resist compressive forces arising in the re-forming process.

It will be appreciated that, in the same way as described in relation to FIGS. 1A and 1B, the inner centre panel tool 60 of FIG. 13B provides no structure between its radially outer peripheral edge 66 and the radially inner peripheral wall of the inner wall tool 70, such that the countersink is freely formed in the peripheral gap between the inner wall tool 70 and the inner centre panel tool 60. The curved base 1014 of the countersink will thus be substantially continuously curved between the radially inner countersink wall 1013 and the radially outer countersink wall 1015. However, the shape of the curved base 1014 of the countersink may instead be controlled by providing an appropriate forming structure on the outer periphery of the inner centre panel tool 60, or by providing a separate, concentric tool between the inner centre panel tool 60 and inner wall tool 70, if desired. Indeed, any of the inner tooling sets of FIGS. 1 to 10 and 12 could be used in conjunction with the outer tooling set of FIGS. 13A and 13B.

In the embodiment of FIGS. 13A and 13B, the indicated dimensions and ratios are the same as noted in relation to the embodiment of FIGS. 1A and 1B above.

It will be understood that the present invention is not limited to the specific examples and embodiments described above, but is to be understood as encompassing these. Further, the specification describes drawbacks of the prior art and benefits of structure, function, and methods of the present disclosure, but the present invention is not limited by the problems or benefits described herein. The scope of the invention is defined by the appended claims, and includes all equivalents within the spirit and scope of the claims.

The invention claimed is:

1. A can end shell formed by drawing a sheet metal blank, the can end shell having a drawn central portion and a surrounding peripheral portion, the peripheral portion including a seam and a chuckwall extending radially and axially inwardly from the seam, wherein the drawn central portion is substantially bowl-shaped and has a side wall extending axially and radially inwardly from the chuckwall, the side wall being concavely curved with respect to an axially outer side of the can end shell and extending outwardly from a region at a centre of the shell with a radius of curvature on the axially outer side surface of within 2 mm and 30 mm.

2. The can end shell of claim 1, wherein the radius of curvature is within 3 mm and 25 mm.

3. The can end shell of claim 1, wherein the side wall has a minimum thickness of no less than or equal to 85% of the thickness of a thickest part of the can end shell.

4. The can end shell of claim 1, wherein the chuckwall is joined to the side wall via a curved annular bend that is convexly curved with respect to the axially outer side of the can end shell.

5. The can end shell of claim 1 further including a substantially straight wall portion between the chuckwall and the side wall, wherein said substantially straight wall portion is aligned substantially parallel to a can end shell axis.

6. The can end shell of claim 1, wherein the chuckwall has a curved shape or includes one or more bends between straight sections of the chuckwall, a can end shell axis defining a larger angle with an axially-inner end of the chuckwall than with an axially-outer end of the chuckwall.

* * * * *